US006223575B1

(12) United States Patent
Kusakabe et al.

(10) Patent No.: US 6,223,575 B1
(45) Date of Patent: May 1, 2001

(54) TUBE FORMING MACHINE USING THREE POINT BENDING

(75) Inventors: Yukio Kusakabe, Kobe; Kazuo Omura, Kakogawa; Hirokazu Mori, Kobe, all of (JP)

(73) Assignee: Kusakabe Electric & Machinery Co., Ltd., Kobe (JP)

( * ) Notice: Subject to any disclaimer, the term of this patent is extended or adjusted under 35 U.S.C. 154(b) by 0 days.

(21) Appl. No.: 09/378,722

(22) Filed: Aug. 23, 1999

(30) Foreign Application Priority Data

Aug. 25, 1998 (JP) ..... 10-237561

(51) Int. Cl.[7] ..... B21D 39/02
(52) U.S. Cl. ..... 72/52; 72/252.5
(58) Field of Search ..... 72/51, 52, 178, 72/181, 182, 252.5; 492/1, 30

(56) References Cited

U.S. PATENT DOCUMENTS 4,122,696 * 10/1978 Midzutani et al. ..... 72/52
5,016,459 * 5/1991 Kuramoto ..... 72/178
5,878,614 * 3/1999 Okamoto ..... 72/52
5,943,892 * 8/1998 Hoshi et al. ..... 72/52

* cited by examiner

*Primary Examiner*—Rodney A. Butler
(74) *Attorney, Agent, or Firm*—Baker & McKenzie

(57) ABSTRACT

A tube forming machine for making a tube from a sheet is disclosed. The forming rolls of this invention include various V-shaped rolls at least some of which are used as part of a three-point bending technique. The three-point bending technique entails the use of a V-shaped bottom roll and a narrow top roll. The sheet is shaped running the sheet through a gap between the narrow top roll and the V-shaped bottom roll. The technique allows a wide variety of tubing to be made from the same set of forming rolls, because the curvature obtained in a sheet can be varied by opening or closing the gap. A V-shaped forming roll disclosed herein is also used at a pinch roll stand with a second complementary V-shaped roll. The pinch roll stand of this invention creates an initial V-shaped sheet which facilitates the threading of the sheet at the start of a forming operation. Brimmed rolls are also disclosed. Brimmed rolls have a relatively sharp included angle, and are used to engage the edges of a sheet and to press the sheet against a single bottom roll in brimmed roll stand.

11 Claims, 30 Drawing Sheets

TUBE FORMING MACHINE USING THREE POINT BENDING

BACKGROUND AND SUMMARY OF THE INVENTION

The present invention relates to an apparatus for manufacturing tubing from sheet stock using a series of rolls. In particular, the invention relates to an improved tube forming machine and method which utilizes new roll shapes and bending techniques which provide a number of advantages over prior art machines and methods.

Steel tubes have for many years been produced by forming an initially flat sheet or strip into a round shape using cage rolls, cluster rolls and fin-pass rolls, and eventually welding the edges of the sheet together to form a seam. Conventional equipment utilizing such rolls for the formation of steel tubing from strips can be seen in U.S. Pat. Nos. 5,673,579 and 5,784,911.

Because a large component in the cost of producing steel tubing from sheet material is the cost of the sheet material itself, producers of steel tubing are often forced by competition to use the least expensive sheet steel available. However, inexpensive sheet stock often has more variability in the hardness, thickness and other important properties of the sheet as compared to more expensive sheet stock. When inexpensive steel sheet is used with traditional tube forming machines and techniques, a number of problems arise. Those problems include twisting of the sheet as it passes through the various rolling stands, difficulty in controlling the position of the sheet, and difficulty in feeding the sheet at the start of a continuous tube forming operation. Conventional tube forming machines require rolls to be changed frequently in order to form tubing having different sizes and wall thicknesses. It is therefore desirable to provide a tube forming machine which has improved ability to handle inexpensive sheet steel and which has increased capacity to make tubing from different forming rolls.

Important objectives in the design of tube forming equipment include ease of initial threading of the strip into and through the machine, consistent positioning of the sheet both at the forming stands and at the point in the process where the edges of the sheet are welded to form a seam, efficient handling of the strip without damaging either the edges or the surfaces of the sheet, and ability for the machine to handle a wide range of tubing sizes and wall thicknesses without changing the forming rolls.

The present invention utilizes three point bending techniques at various stages in the tube forming operation. One of the three point bending techniques of the present invention involves the use of a V-shaped roll and an opposing narrow roll, with the extent of curvature obtained depending on the relative position, i.e., the proximity, of the two roll. If the narrow roll is brought closer to the V-shaped roll with which it cooperates, a smaller diameter is obtained. Conversely, if the gap between the narrow roll and the V-shaped roll is increased, a larger diameter results. The present invention also utilizes a V-shaped bottom and top roll at an initial or pinch roll stand. The flat surfaces of opposing V-shaped rolls at the first stand in the machine results in improved gripping of the sheet for purposes of driving the sheet through subsequent stands. The resulting V-shaped profile of the sheet after it leaves the initial pinch roll stand is a strong shape for purposes of driving the sheet as it is threaded through the remaining non-driven stands. The initial forming stand is equipped with a duplex regulating system in which hydraulic pressure is used to pinch the sheet between the two V-shaped rolls. Each side of the top roll of the initial station may be independently controlled for purposes of adjusting pressures applied to each side of a sheet being processed to compensate for variability of thickness of the sheet material.

The tube forming machine described below also includes the use of a brimmed roll in which a circumferential slot is formed between two angled surfaces. A pair of brimmed rolls are used to engage the edges of a sheet, and the two brimmed rolls cooperate with a concave bottom roll to form the sheet into a smoothly rounded cross-section.

More detailed descriptions of the inventions disclosed herein are set forth below and will be better understood upon a reading of the following specification read in conjunction with the accompanying drawings wherein:

DETAILED DESCRIPTION OF THE INVENTION

Figure 1:
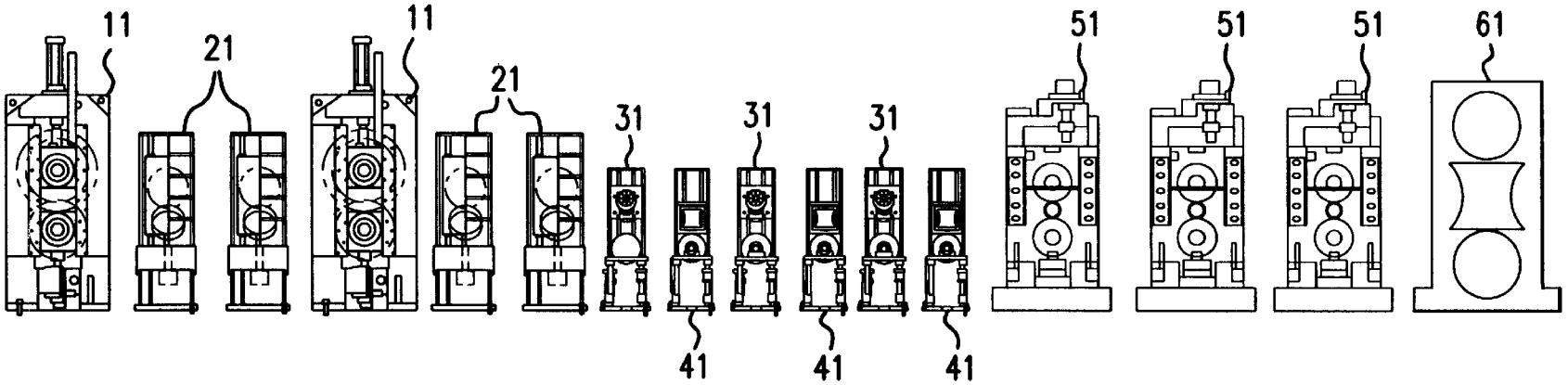
FIG. 1 is an overall side elevational view of a machine arranged in accordance with the present invention.

FIG. 1 is a side elevational view showing the various forming stations used in accordance with the present invention. The tube forming machine of the present invention includes pinch roll stands 11 at the first and fourth stations shown in FIG. 1. The second, third, fifth and sixth stations are three point bending stands 21. The seventh through twelfth stations are alternating brim roll stands 31 and cage roll stands 41. After the alternating brimmed and cage roll stands, a series of three fin-pass stations 51 operate on the sheet which is to be formed into tubing. The final rolling station is a squeeze roll station 61, after which the sheet is welded along a longitudinal seam. As can be seen in the top plan view of FIG. 2, the pinch roll stands and the fin-pass stands 51 are used to drive and pull, respectively, the sheet through the tube forming machine.

Figure 2:
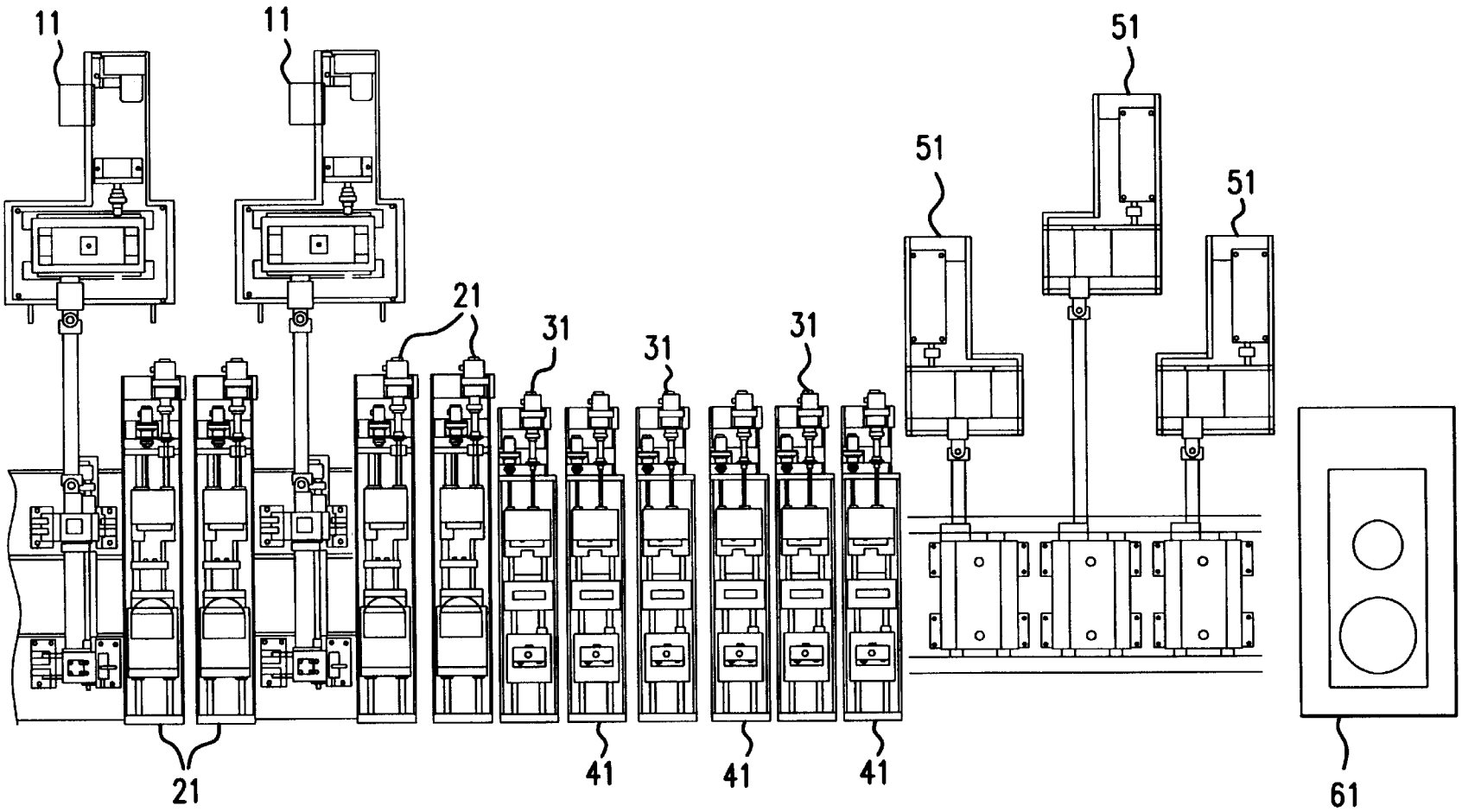
FIG. 2 is a top plan view of the machine shown in FIG. 1.
Figure 3:
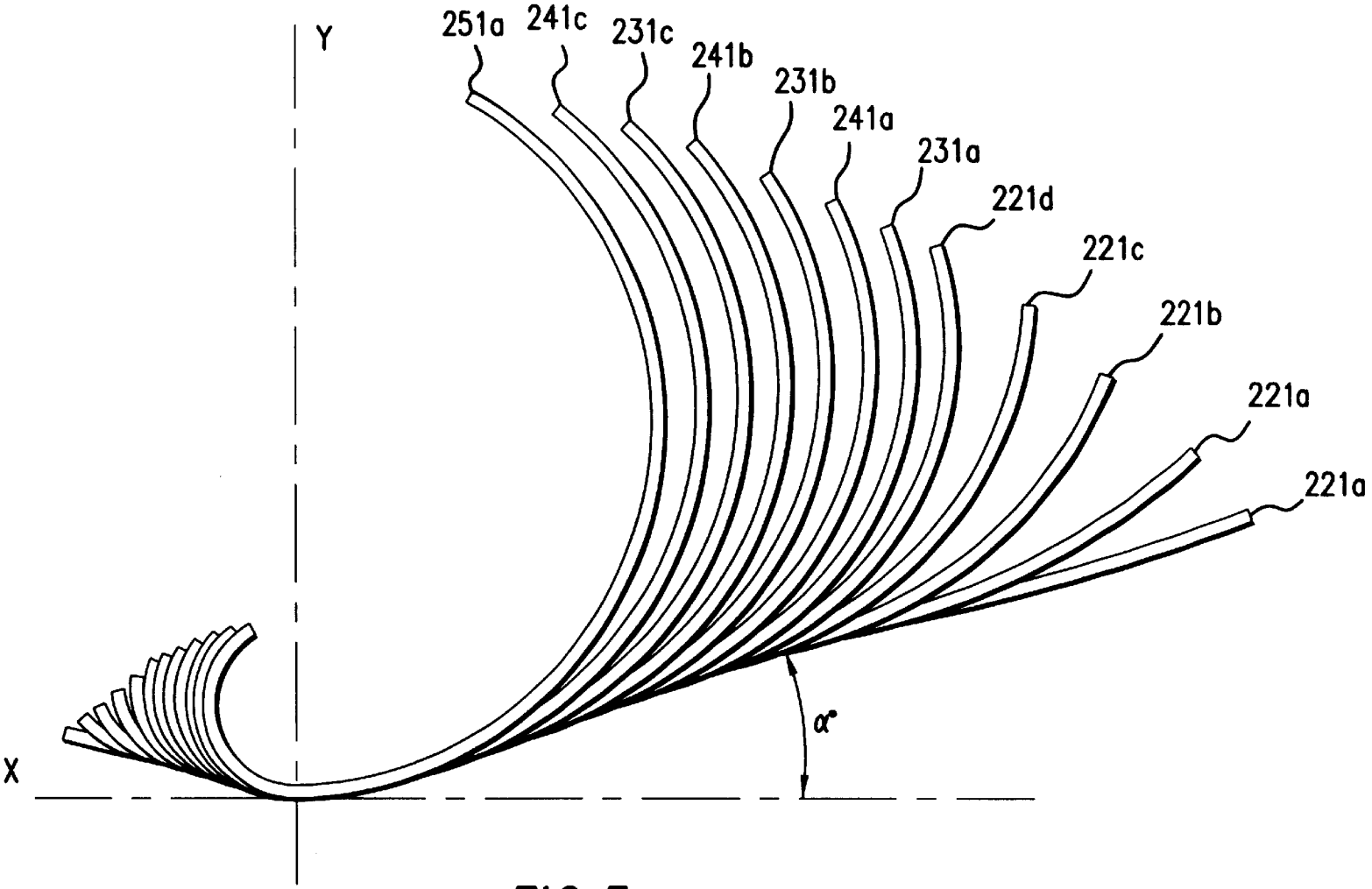
FIG. 3 is a diagram showing the various stages of the tube forming process for large diameter tubing (right side) and small diameter tubing (left side) which can be produced with the machine of the present invention.

FIG. 3 shows the profile of the sheet as it progresses from the initial pinch roll stand through the fin-pass stands. The profile designated 211*a* corresponds to the initial pinch roll stand at the left end of FIGS. 1 and 2. The profiles marked 221*a* through 221*d* correspond to the profile at the four three point bending stands 21. The profiles designated 231*a* through 241*c* correspond to the shape of the sheet at the series of six alternating brimmed rolls and cage roll stands shown in the center portion of FIGS. 1 and 2. Finally, the profile designated 251*a* corresponds to the shape of the sheet at the fin-pass stands 51.

The angle "$\alpha$" (alpha) shown in the lower portion of FIG. 3 is the angle with respect to the horizontal of each side of the initial V-shape of the sheet as it is formed by the top and bottom roll of the pinch roll stands shown in FIGS. 1 and 2. The V-shaped transverse cross-section of a sheet formed by the combination of the first and second pinch roll stands 11 will have good resistance to buckling as it is passed through non-driven roll stands. This resistance to buckling is particularly important with respect to initial threading of a strip at the time when the machine is first started into operation.

Figure 4:
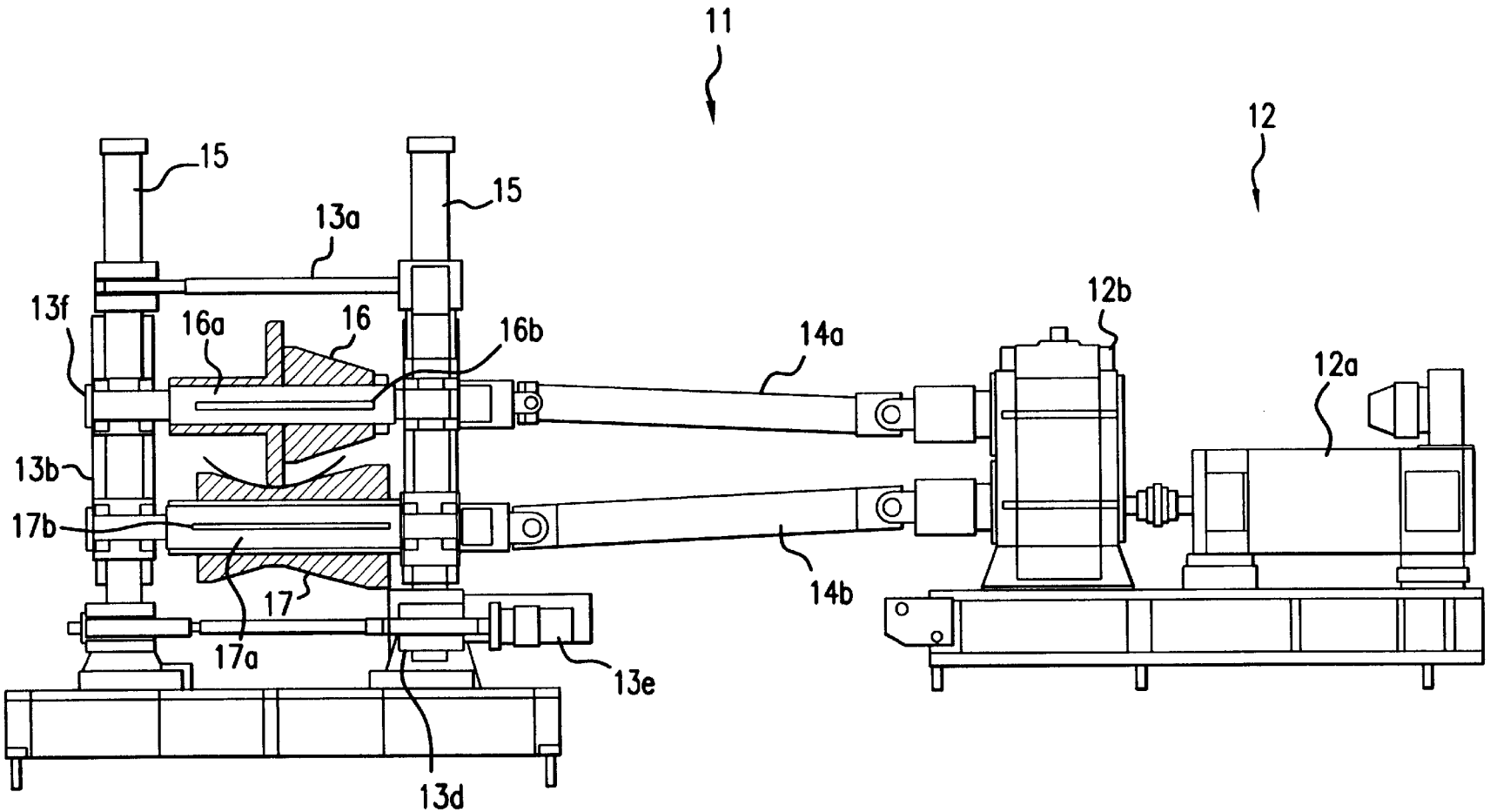
FIG. 4 is an elevational view in partial section of driving stands of the machine of the present invention, the right cross-sectional portion corresponding to the first driving stand and the left cross-sectional portion corresponding to the second driving sheet.
Figure 5:
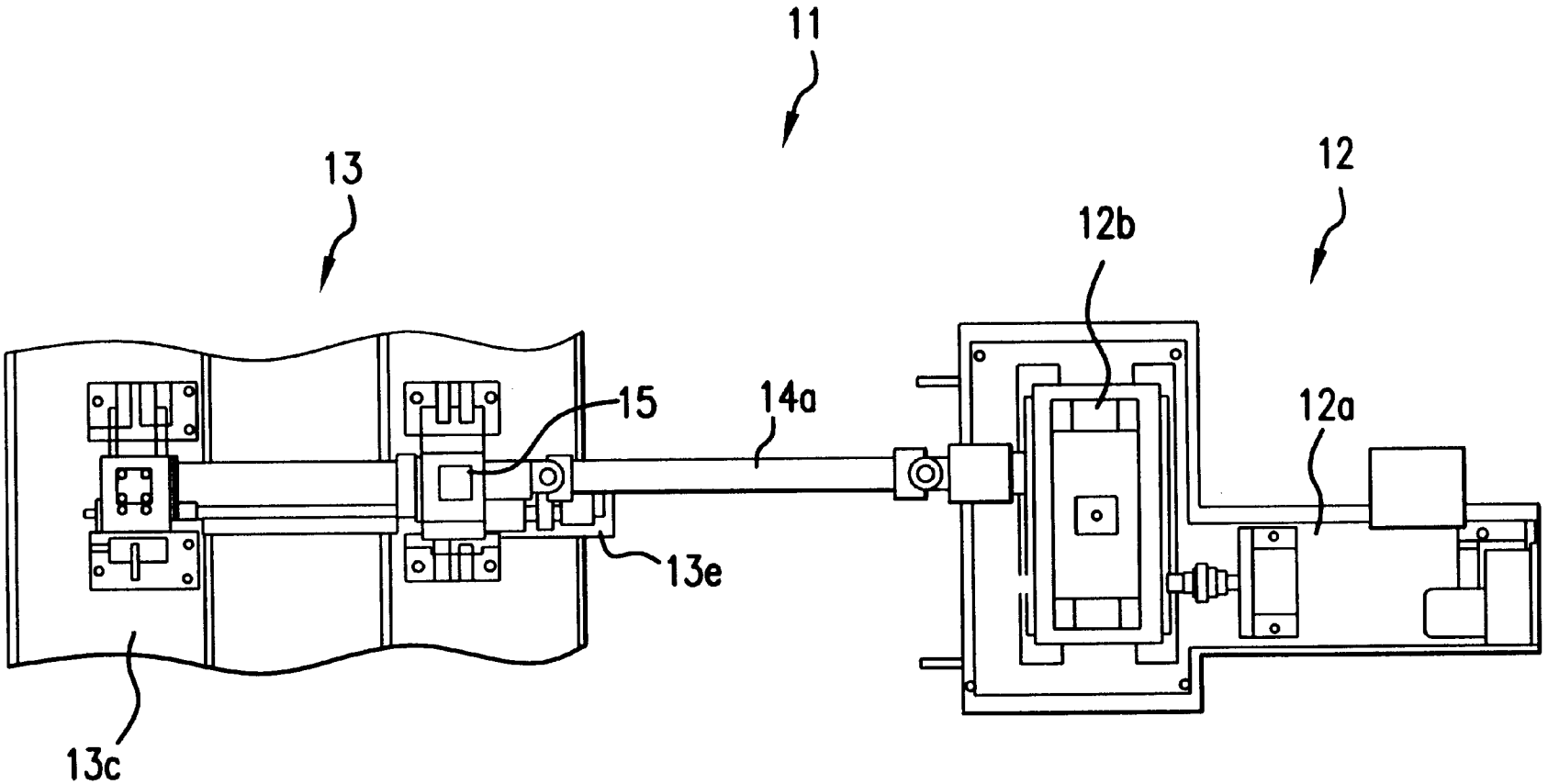
FIG. 5 is a top plan view of the stands shown in FIG. 4 with the rolls not shown.
Figure 6:
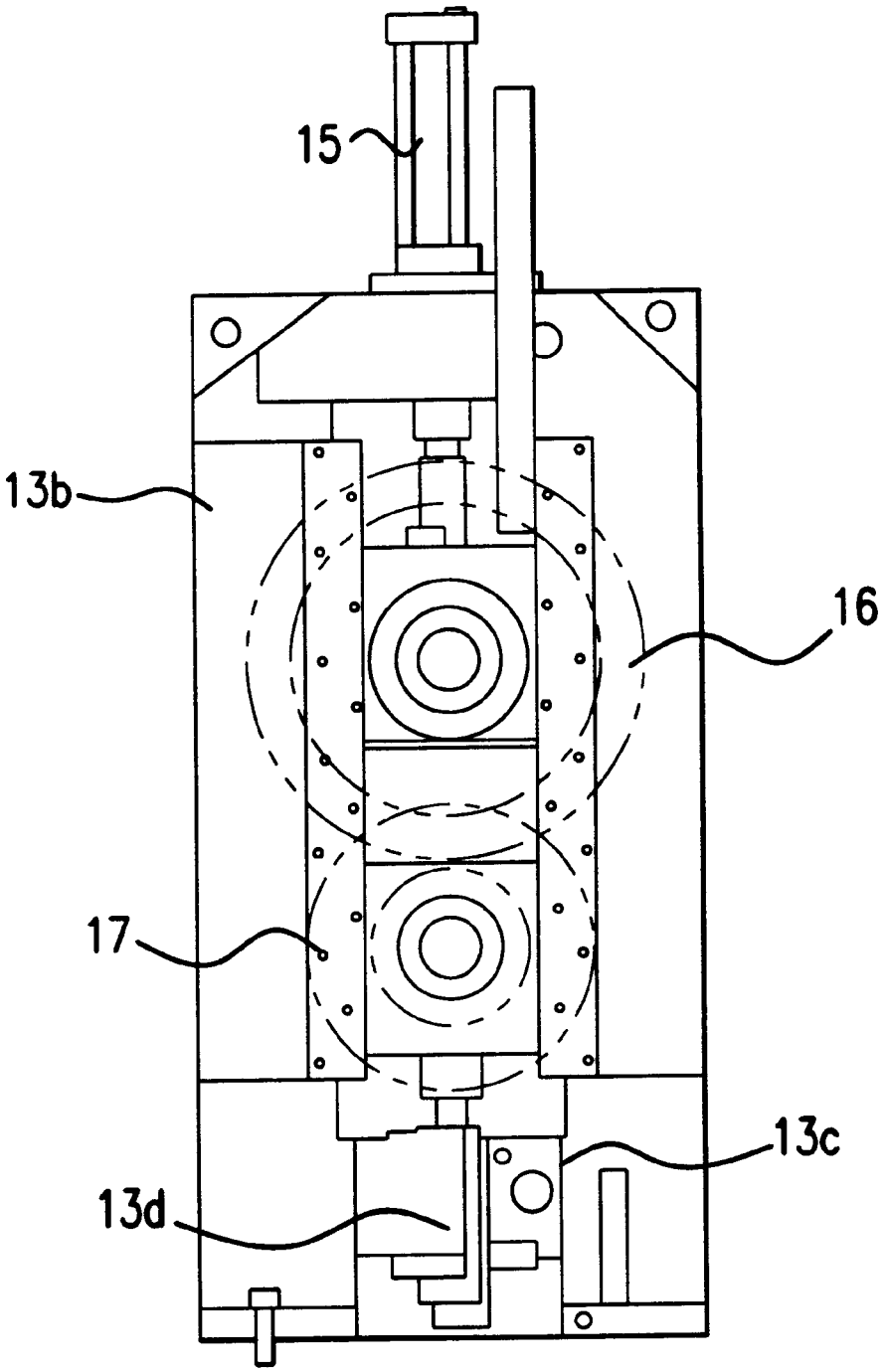
FIG. 6 is a side elevational view of the station shown in FIGS. 4 and 5.

FIGS. 4, 5 and 6 are elevational views of a pinch roll stand 11 with its top and bottom rolls driven by drive equipment 12. The drive equipment 12 includes a gear box 12*b* driven by an electric motor 12*a*. The upper drive spindle 14*a* and lower drive spindle 14*b* are connected to the gear box 12*b* and are also connected to the top roll shaft 16*a* and bottom roll shaft 17*a*, respectively. It should be noted that the right hand portion of the top roll corresponds to the first pinch roll stand in FIGS. 1 and 2, while the left portion of the top roll shown in FIG. 4 corresponds to the second pinch roll stand in FIGS. 1 and 2, which is the fourth in the series of stations shown therein. Because the top and bottom rolls shown in FIG. 4 provide the driving force for the sheet as it is threaded through the tube forming machine of the present invention, it is important that good gripping contact exists between the sheet and the top and bottom rolls. To achieve this, hydraulic cylinder/piston assemblies 15 apply downward force to the shaft 16*a* which supports the top rolls 16. A keyway 16*b* formed in the shaft 16*a* receives a corresponding projection which allows the transfer of driving force to the shaft 16*a* and to the top roll 16.

A roll stand frame 13*b* supports the roll shafts 16*a* and 17*a*. An electric motor 13*e* operates the height adjustment 13*d* for the lower roll 17. As in the case of the upper roll 16, the lower roll 17 has a key which fits into a keyway 17*b* to allow driving forces to be transferred from the lower drive spindle 14*b* to the lower roll 17. The ends of the shafts 16*a* and 17*a* are each supported in a bearing box such as 13*f*. The bearing boxes 13*f* are supported by a frame 13*b*.

Figure 7:
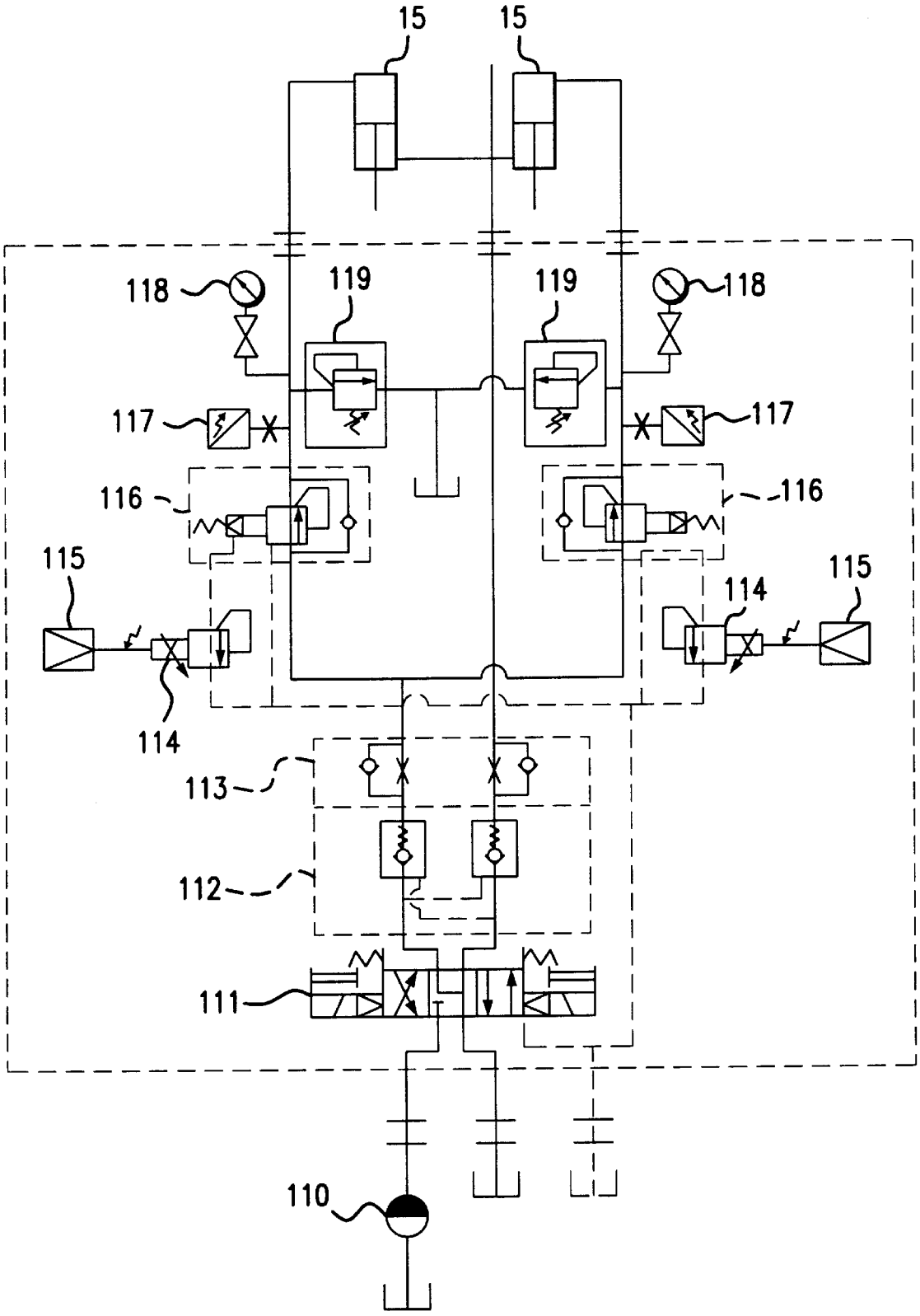
FIG. 7 is a schematic diagram of the hydraulic circuit used to apply clamping pressure at an initial driving stand of the machine of the present invention.

FIG. 7 is a diagram of the hydraulic circuit used to operate the assemblies 15 which apply clamping pressure to the sheet as it passes through the pinch roll stands 11. A hydraulic pump 110 supplies hydraulic fluid from oil reservoirs 120. A solenoid operated directional valve 111 is used to control the flow of hydraulic fluid from the pump to the driving side of the piston within the assemblies 15. The pilot operated check valve 112 prevents backflow of hydraulic fluid in the direction of the solenoid operated directional valve 111. A speed control valve 113 is used as a main control of large flows of hydraulic fluid to the pressing cylinder/piston assemblies 15, whereby hydraulic fluid is used to apply and release clamping pressure to the top roll of a pinch roll stand 11. More precise (i.e., fine) control of clamping pressure is achieved by an operator who may send a signal to the electrical signal converter 115 to apply more or less clamping pressure to one or both cylinders 15. The circuit uses the pressure regulators 114 and 116 to increase or decrease the pressure applied by the pistons within the cylinder/piston assemblies 115. Indeed, the operator in some instances may want to apply more pressure upon one side of a roll than upon another the opposite side of the same roll to compensate for uneveness in the thickness, hardness, friction or other property of a strip being processed.

Pressure relief valves 119 are in the circuit to protect against machine breakage in the event that the rolls encounter an obstacle. The main hydraulic pressure sensors 117 provide a reading of the pressure within the pressing assemblies 15 at the main control panel of the machine. Auxiliary pressure gauges 118 allow visual inspection of the pressure being applied to the clamping rolls at the pinch roll stands 11.

Figure 8:
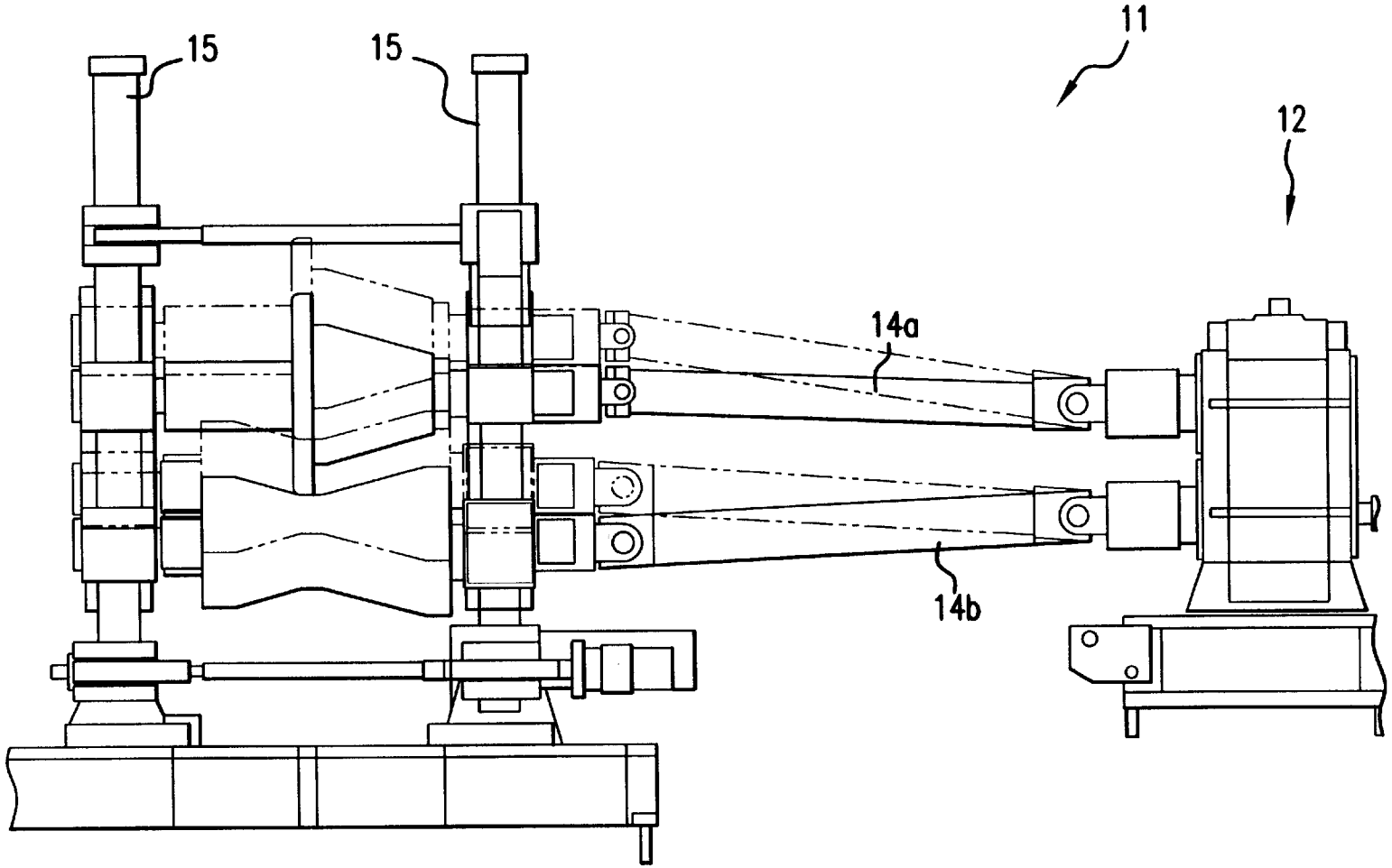
FIG. 8 is a partial side elevational view of a driving stand of the present invention showing the vertical adjustability of the rolls.

As can be seen in FIG. 8, the pressing assemblies 15 are used to raise and lower the top roll of the pinch roll stands 11. The driving equipment 12 is linked by the drive shafts

14*a* and 14*b* through universal joints at each end to the shafts upon which are carried the top and bottom rolls of the pinch roll stands 11.

Figure 9:
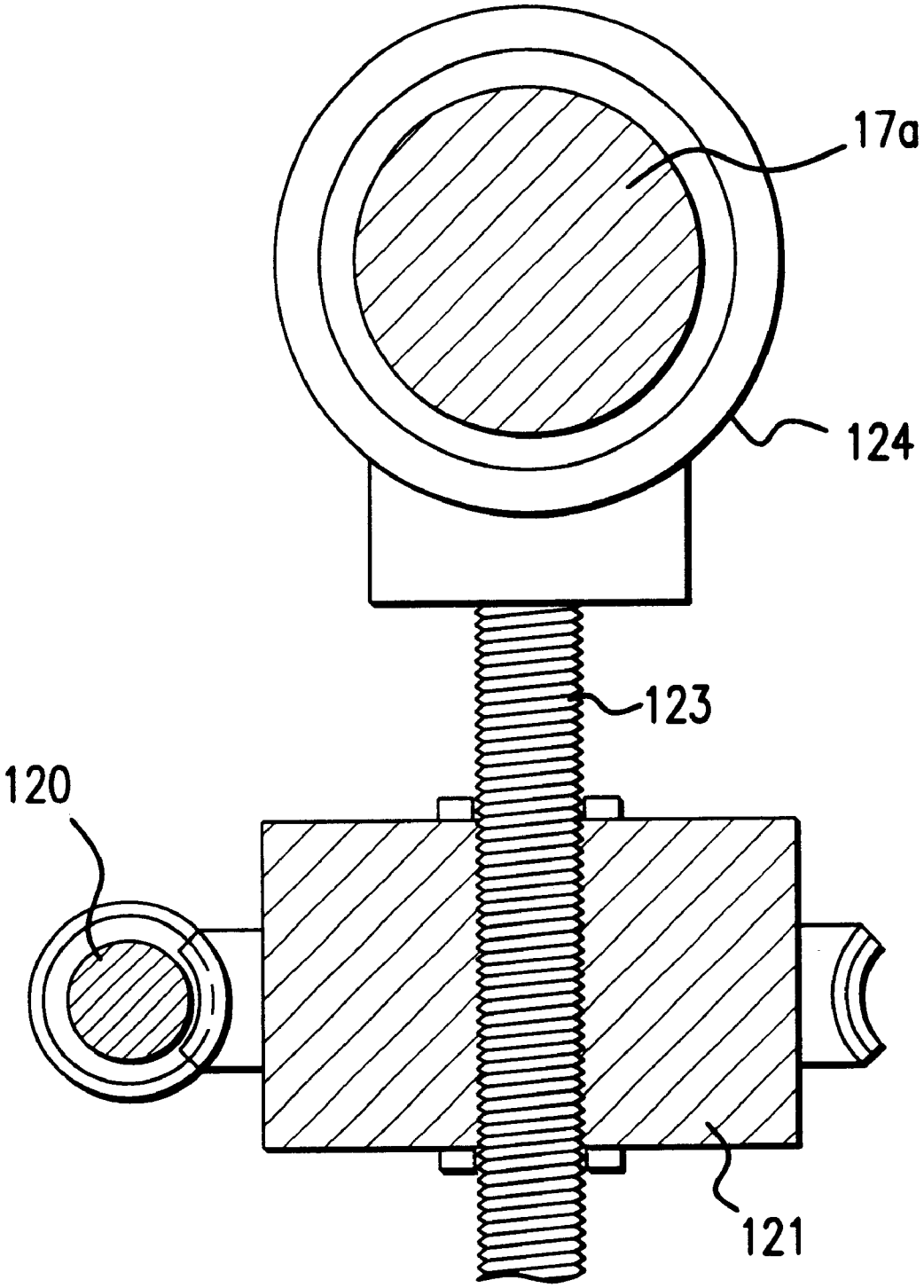
FIG. 9 is an elevational view in partial section of the adjustment mechanism for a bottom roll.
Figure 10:
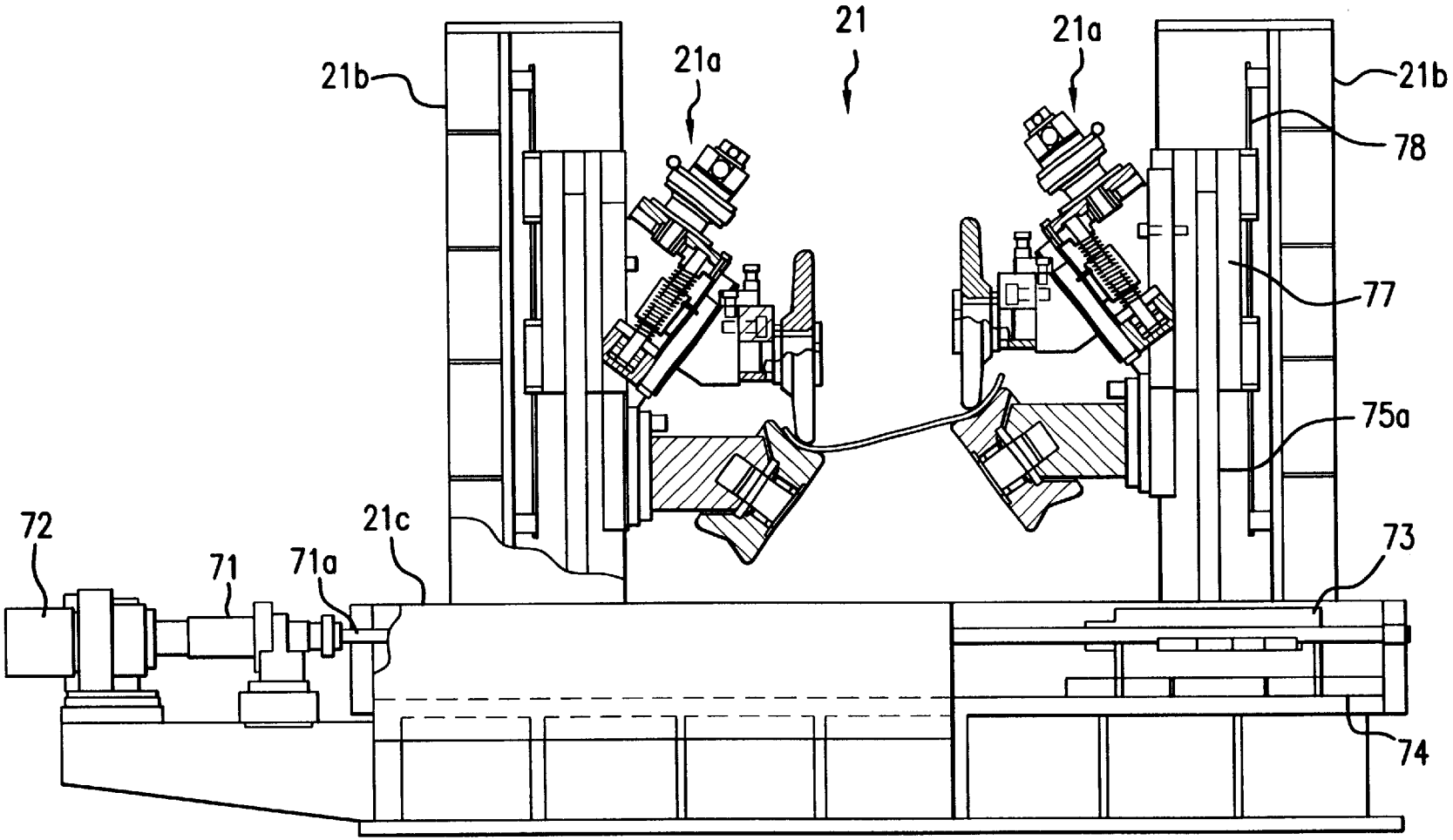
FIG. 10 is an elevational view in partial section of a forming roll stand of the present invention.
Figure 11:
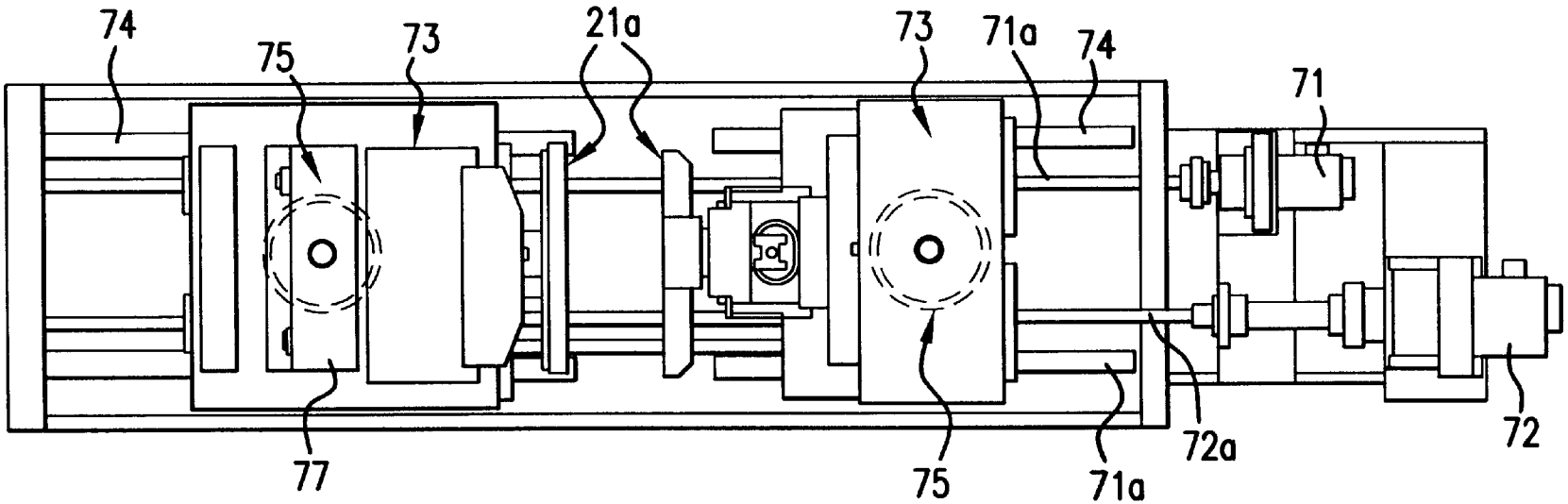
FIG. 11 is a top plan view of the stand shown in FIG. 10.
Figure 12:
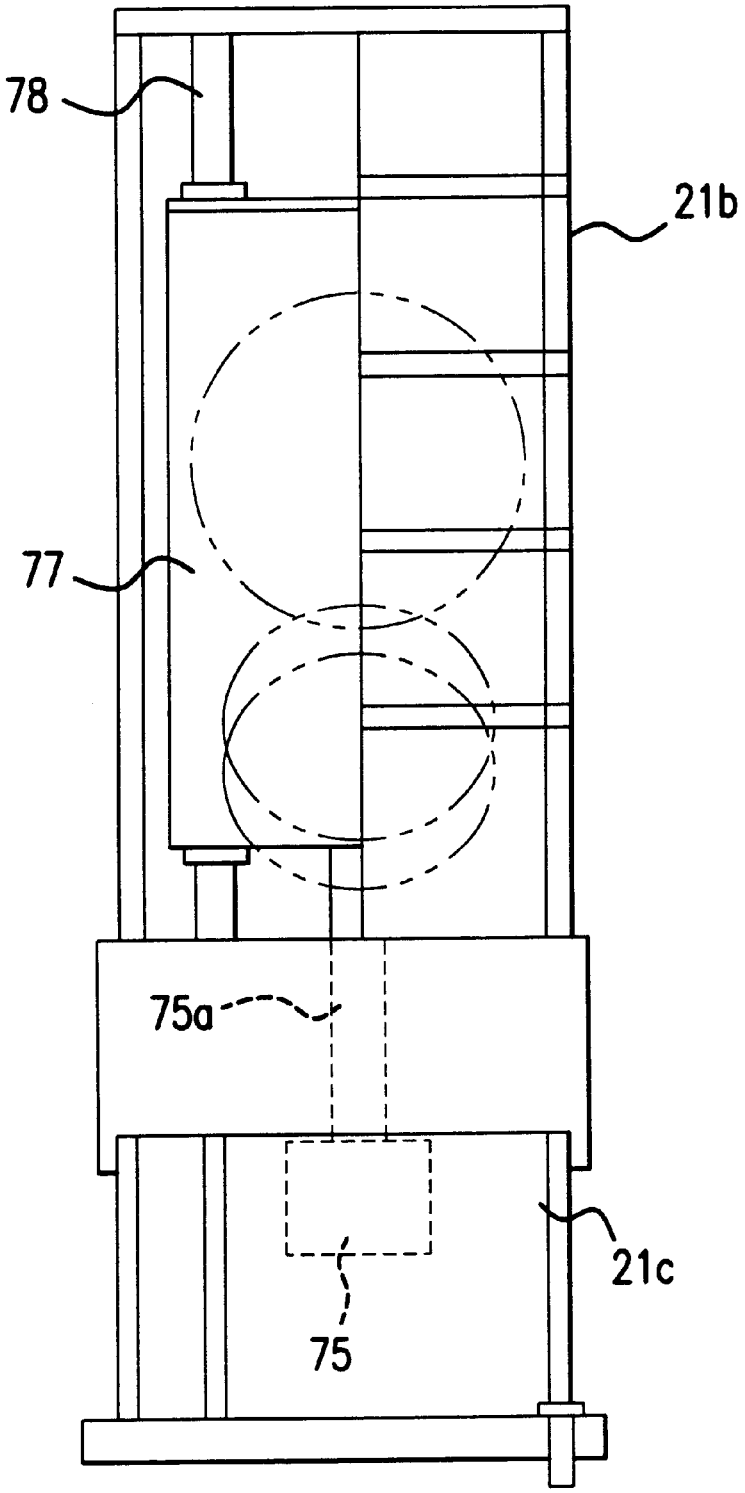
FIG. 12 is a side elevational view of the stand shown in FIGS. 10 and 11.
Figure 13:
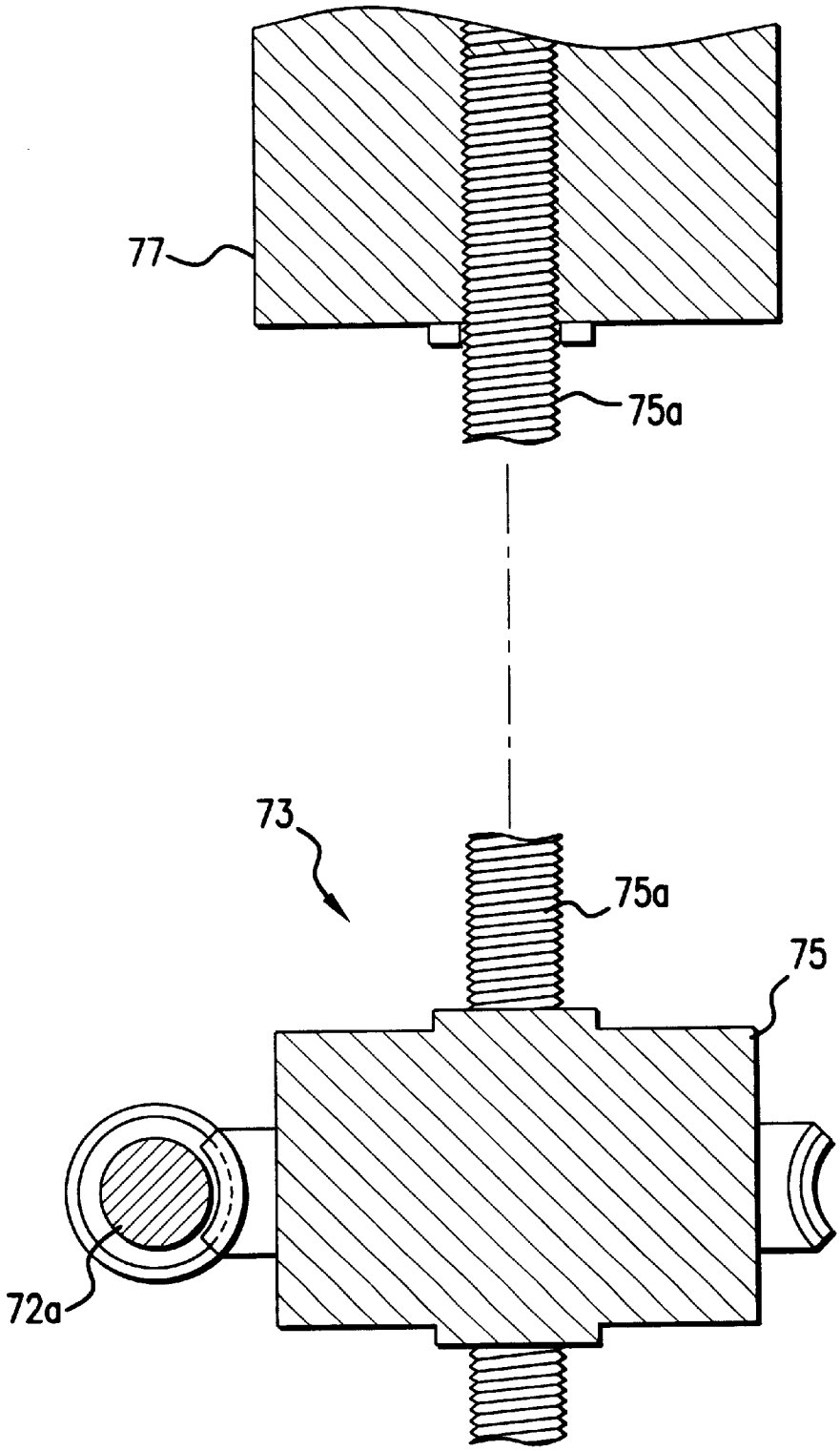
FIG. 13 is an enlarged elevational view in partial section of the mechanism used to vertically adjust the rolls shown in FIG. 10.
Figure 14:
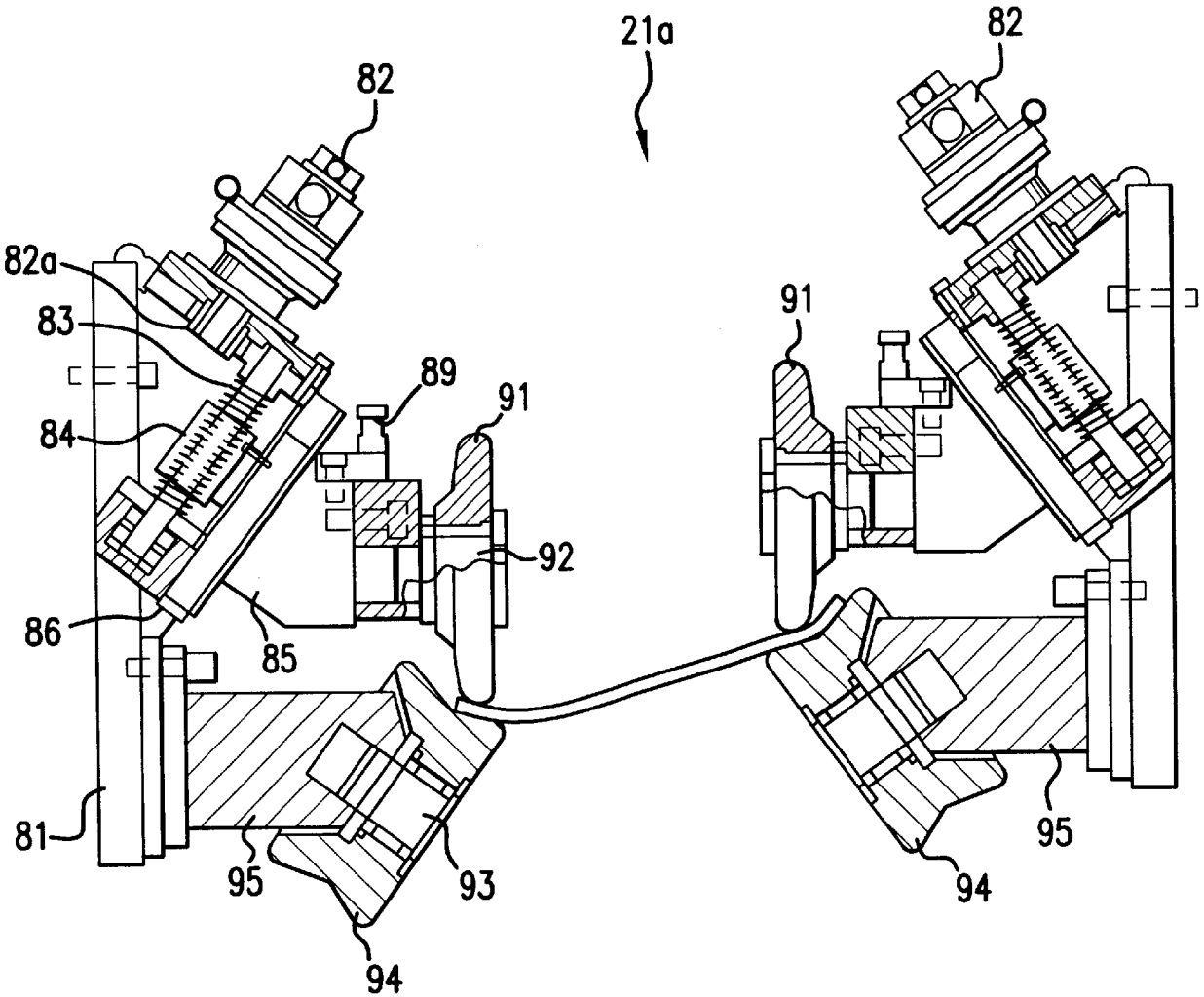
FIG. 14 is an enlarged elevational view in partial section of a three point bending stand of the present invention.
Figure 15:
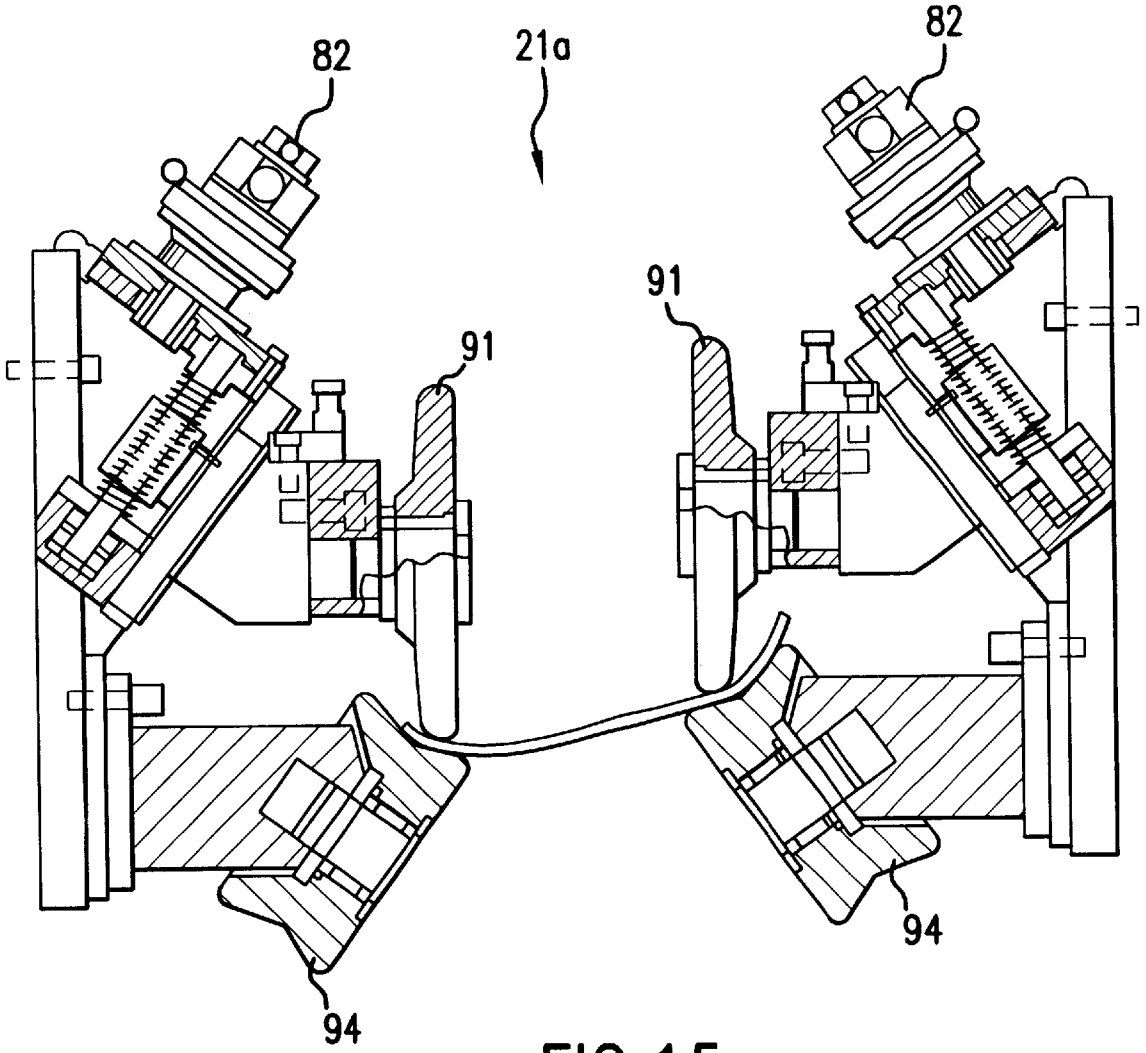
FIG. 15 is an enlarged elevational view in partial section of a second three point bending stand of the present invention.
Figure 16:
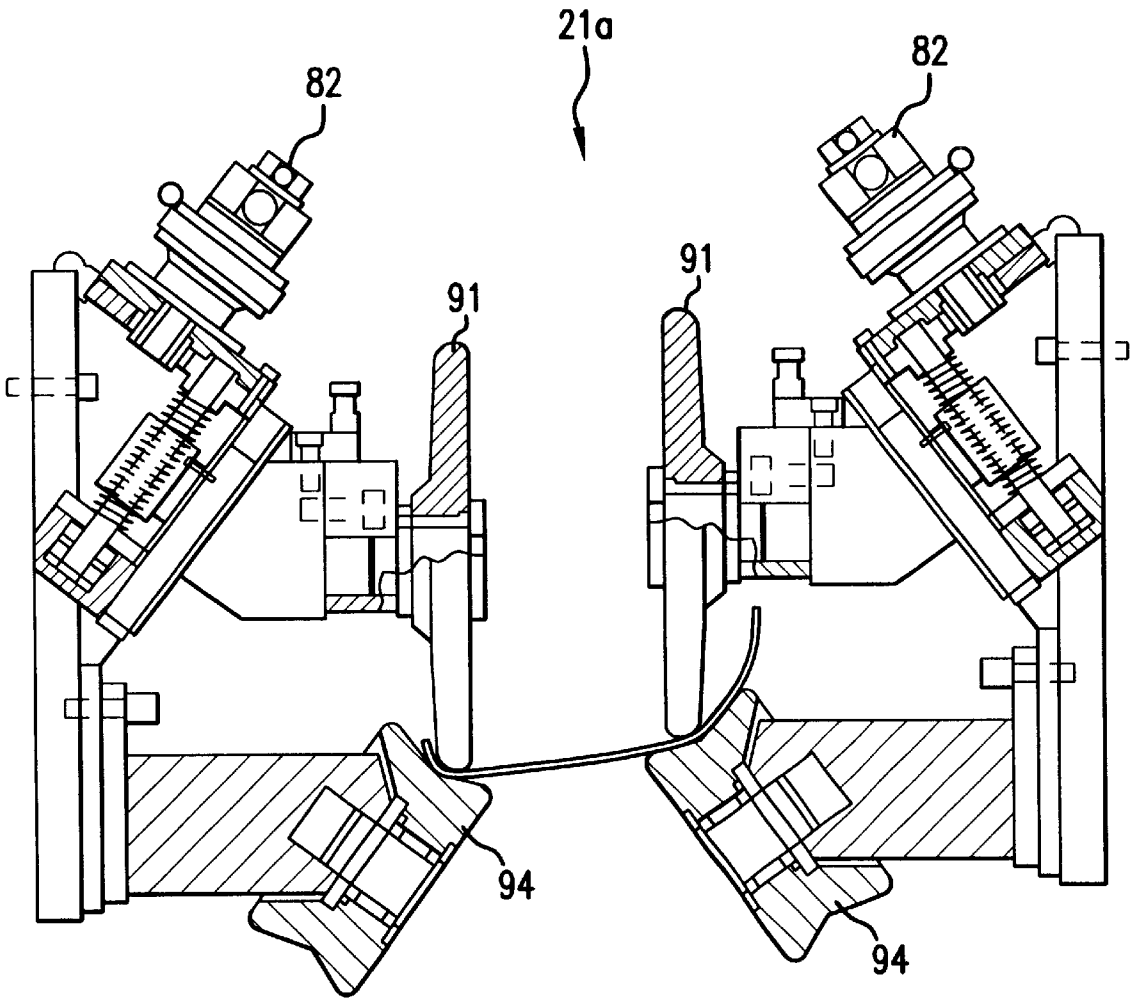
FIG. 16 is an enlarged elevational view in partial section of a third three point bending stand of the present invention.
Figure 17:
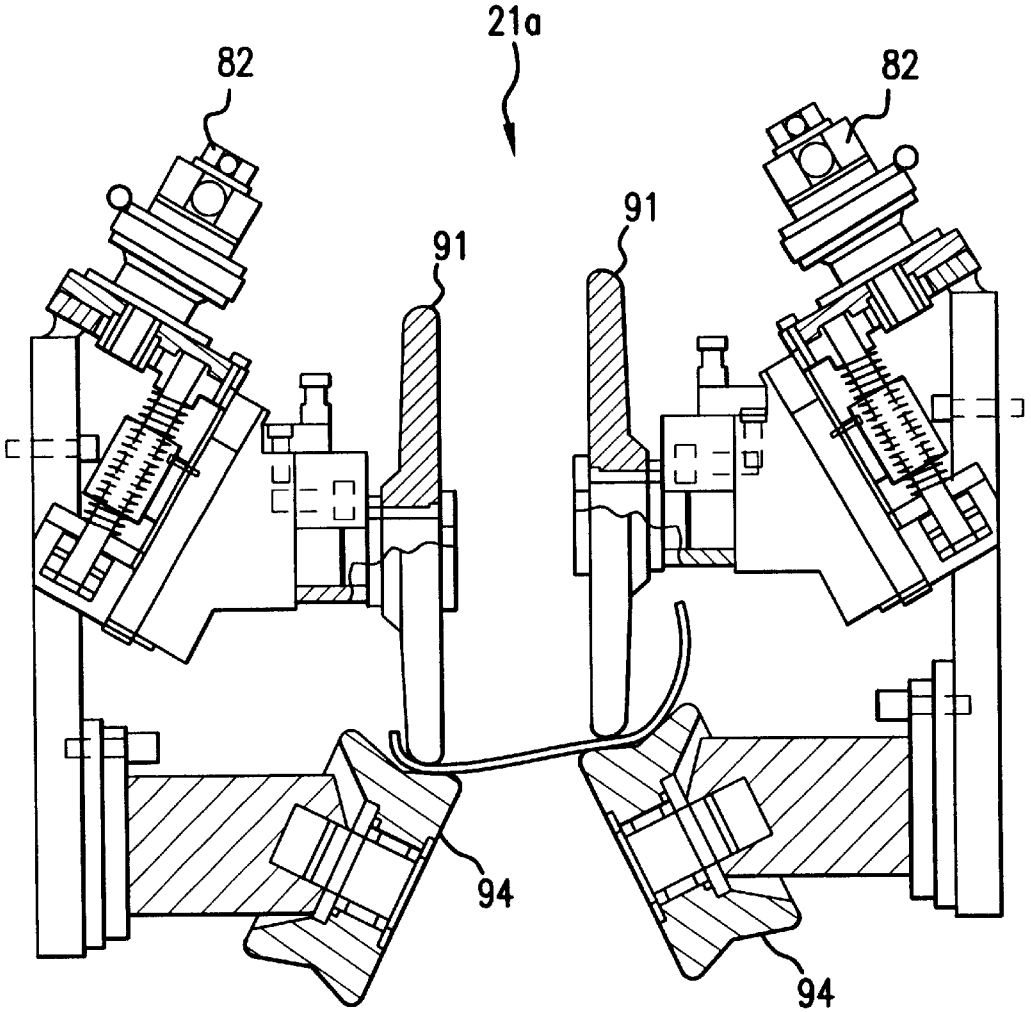
FIG. 17 is an enlarged elevational view in partial section of a fourth three-point bending stand of the present invention.
Figure 18:
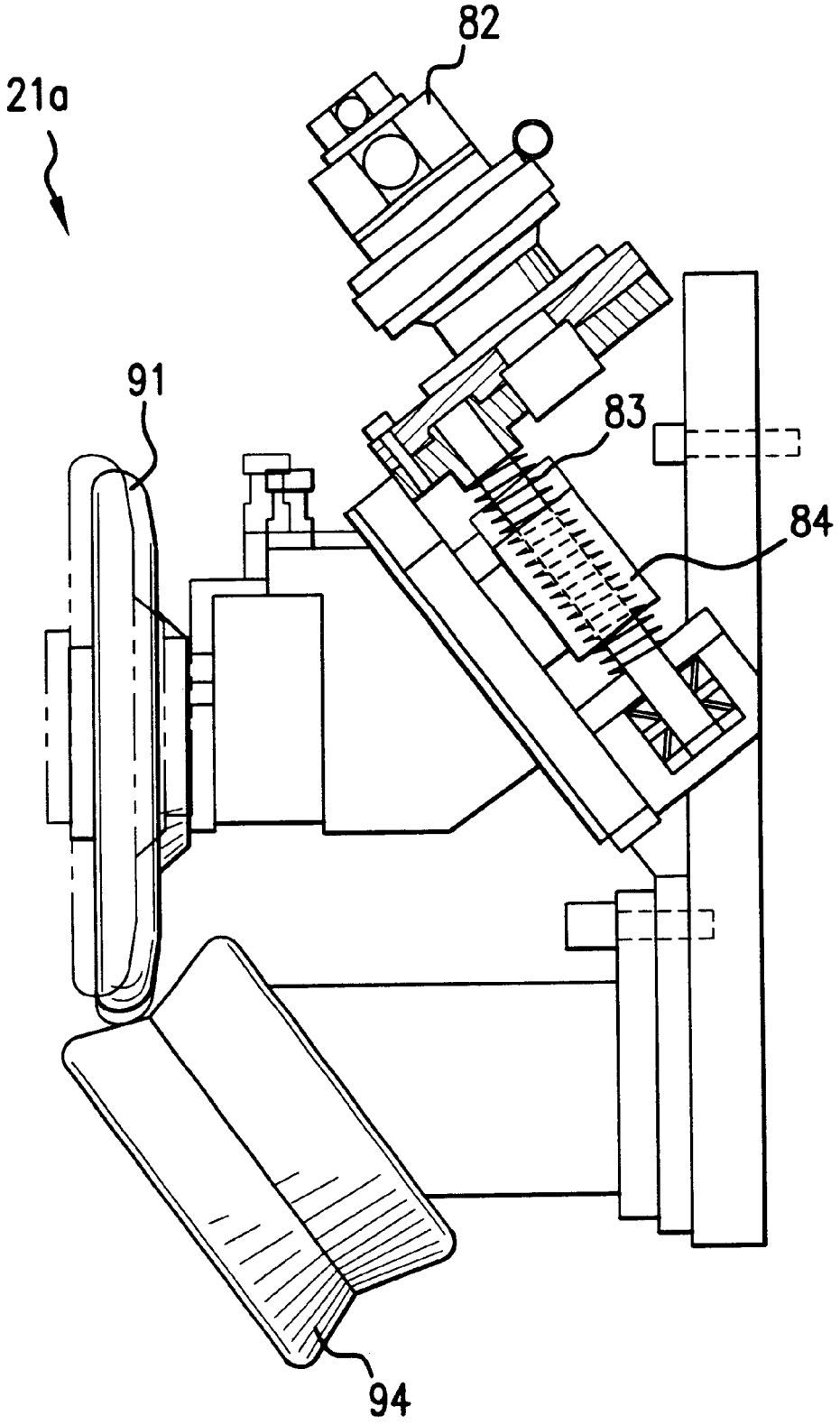
FIG. 18 is an enlarged elevational view in partial section of a top and bottom roll at a three point bending stand of the present invention.

FIG. 9 shows the basic elements of the mechanism used to raise and lower the bottom roll of a pinch roll stand 11. The bottom roll shaft 17*a,* upon which is mounted the bottom roll 17, extends into a bearing box 124. The bearing box 124 is mounted to a lifting screw 123 which is raised and lowered by rotation of the worm wheel 121. Rotation of the worm wheel 121 is achieved by rotation of the worm 120.

FIGS. 10, 11, 12 and 13 are end elevational, top plan and side elevational views, respectively, of a three point bending roll stand 21. A three point bending roll stand 21 of the present invention includes a pair of opposing rolls, a top roll 91 and a bottom roll 94. Each pair is mounted to a main vertical frame 21*b* which carries a forming roll mechanism 21*a,* described in more detail below. The forming roll mechanism 21*a* is carried by a vertical slide frame 77 which slides along a vertical slide rail 78. Rotation of the screw rod 75*a* causes the raising and lowering of the slide frame 77 and the forming roll mechanism 21*a.* The screw rod 75*a* is rotated by operation of the forming roll height adjust drive motor 72 through drive worm shaft 72*a* and worm wheel 75.

Horizontal adjustment of the main vertical frames 21*b* is achieved by operation of the forming roll with adjust drive motor 71. Operation of the motor 71 causes rotation of the driving worm shaft 71*a* which causes horizontal movement of the main vertical frames 21*b,* toward and away from each other depending on the direction of the rotation of the shaft 71*a.*

FIGS. 14 through 18 are more detailed depictions of the forming roll mechanisms of a three point bending stand 21. Each forming roll mechanism includes a roll gap adjusting motor 82 which drives a pinion 82*a.* The pinion 82*a* engages a gear fixed to the end of a screw rod 83. The screw rod 83 is axially fixed but rotatable within an internally threaded member 84 such that rotation of the screw rod 83 results in movement of the threaded member 84 along the screw rod 83. The top roll holder 85 is connected to the threaded member 84 and slides along a top roll slide roll 86 when the screw rod 83 is rotated within the threaded member 84. Motion of the top roll holder 85 along the slide rail 86 causes movement of the top roll 91 towards or away from the bottom roll 94. As can be seen in FIGS. 14 through 18, the main adjustment of the position of the top roll 91 is at an angle of about 45° relative to horizontal. A fine adjustment mechanism 89 may be used to further adjust the position of the top roll 91 with respect to its associated bottom roll 94. The bottom roll 94 is mounted to a bottom roll support shaft 93 which is in turn carried by a bottom roll holder 95. The bottom roll holder 95 is attached to and carried by a vertical base plate 81. Depending upon the gap between the top roll 91 and the bottom roll 94, the curvature of the sheet passing through the rolls 91 and 94 can be increased or decreased by the use of the three point bending technique which will be described in more detail below.

Figure 20:
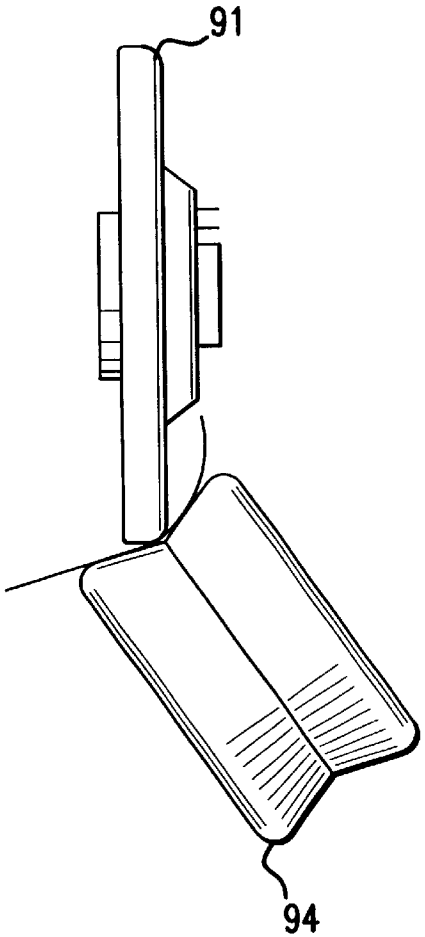
FIGS. 19 and 20 are elevational views of a top and bottom roll showing alternative ways in which the rolls may be adjusted to obtain different curvature in a workpiece.
Figure 19:
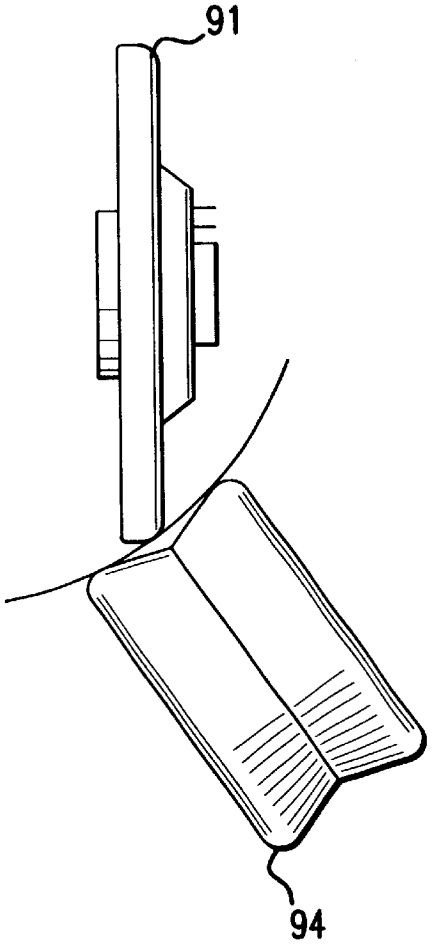

Each of the bottom rolls 94 shown in FIGS. 14 through 18 has a V-shaped configuration which supplies two of the three points in a three point bending technique. The top roll 91 is a generally narrow roll which provides the third and middle point of a three point bending operation. As can be seen in FIGS. 19 and 20, bringing the top roll 91 close to the bottom roll 94 results in a relatively sharp, or small radius, curvature in the sheet between the rolls for use in making smaller diameter tubing. In contrast, the provision of a larger gap between the top roll 91 and the bottom roll 94 results in a less curved sheet as shown in FIG. 19, which results in larger diameter tubing. The same top and bottom rolls are used in each case, thus reducing costs associated with the manufacture (or acquisition) or rolls and the labor and down-time associated with changing rolls.

The shape and orientation of the top rolls 91 and bottom rolls 94 in a three-point bending stand 21 are important. The bottom rolls 94 have an overall V-shaped configuration, with each bottom roll 94 having two frustoconical (i.e. partially conical) sections which meet at a circumferential crease. The crease defines a plate in which the bottom rolls 94 are disposed. The planes defined by the two bottom rolls of a three-point bending stand are generally parallel to the longitudinal axis (or Z-axis ) of the machine, i.e. they are generally parallel to the direction of the flow of workpiece material through the machine. The three points (or workpiece engagement locations) referred to as part of a three-point bending technique are the two points of contact on the V-shaped bottom rolls 94, and the single point of contact provided by the narrow top roll 91. The degree of curvature obtained by this combination of rolls can be varied greatly simply by adjusting the gap between the rolls. Depending upon the thickness of the sheet material and the distance between the top and bottom rolls, a small or large diameter bend will be imparted to the sheet. One distinct advantage of using a three-point bending technique of the present invention is the reduced amount of friction as compared with tube forming methods in which there is broad lengths of contact between a forming roll and a workpiece. The broad lengths of contact not only create added friction which is not the case with the present invention, but more contact can, in some instances, result in a greater chance for marring of the surface of tube, which can result in tubing products which are not acceptable to customers. It should be noted that planes as they are referred to herein, and in the tube forming field generally, are defined with reference to axes, i.e. the X-axis being the transverse horizontal axis (with respect to work flow), the Y-axis being a vertical transverse axis, and the Z-axis being the longitudinal axis or the direction of work flow. A plane is sometimes identified by reference to the axes which lie in or are parallel to the plane.

Figure 21:
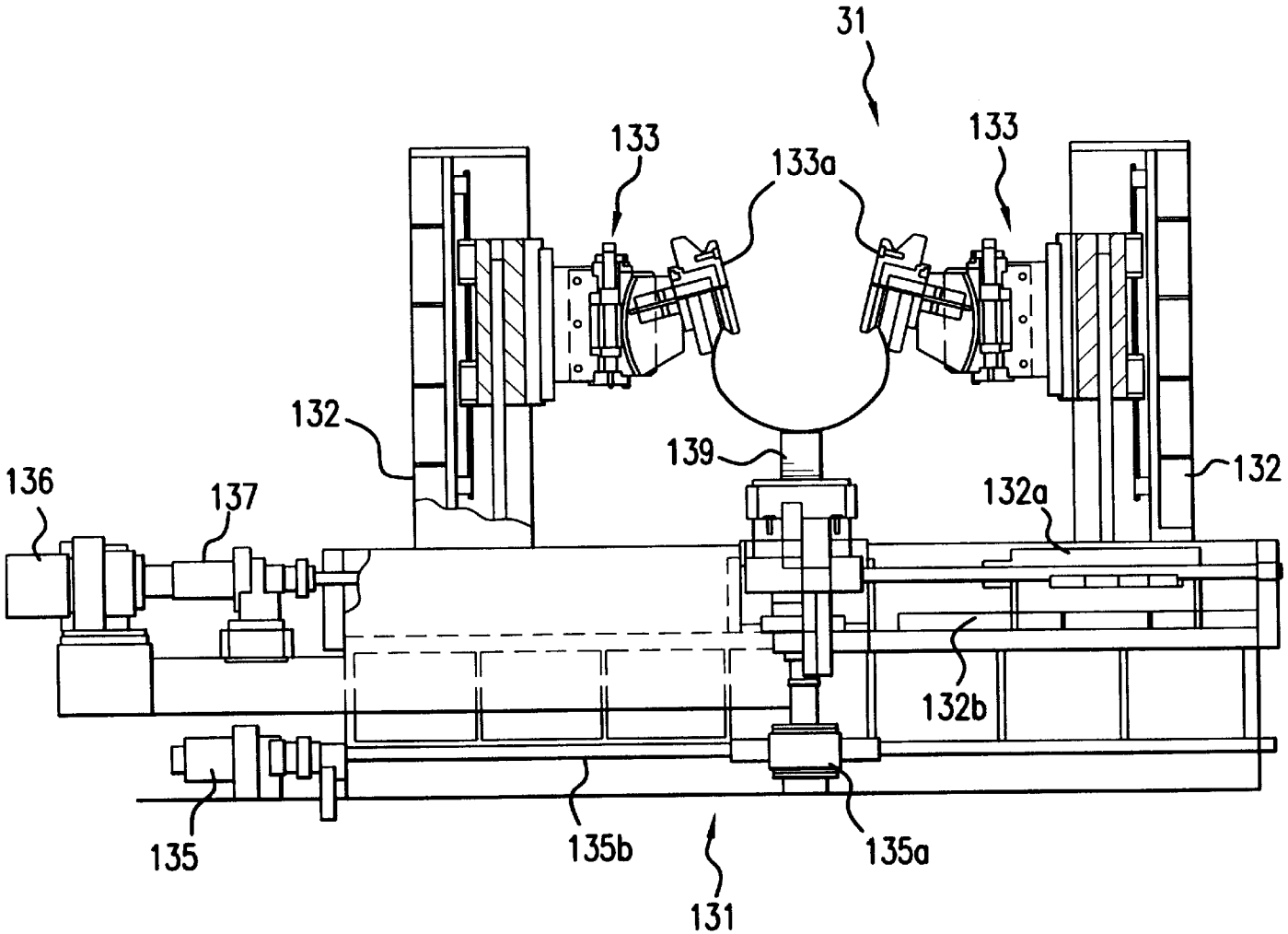
FIG. 21 is an elevational view in partial section of a forming stand of the present invention in which brimmed rolls are utilized.
Figure 22:
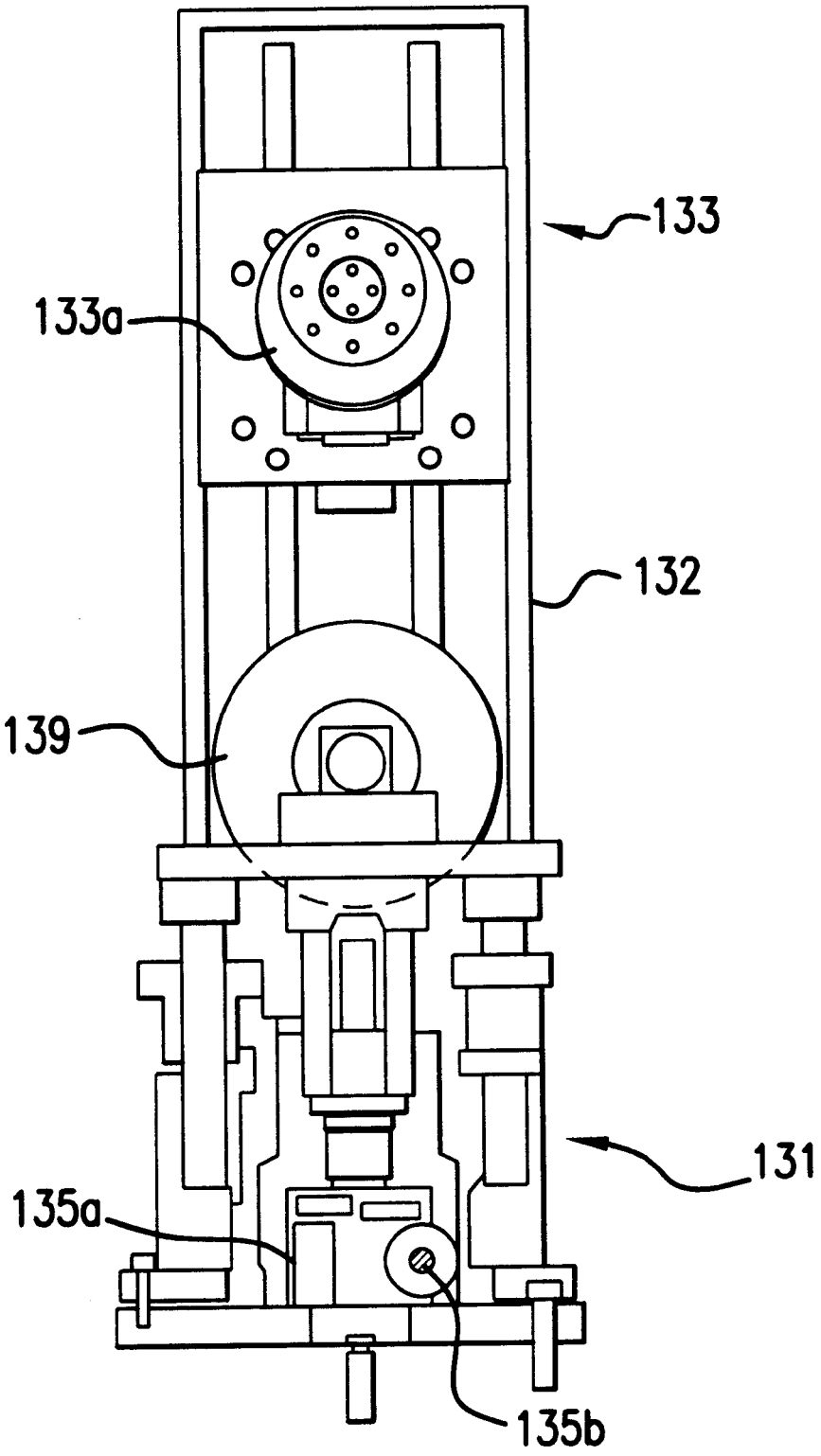
FIG. 22 is a side elevational view of one side of the stand shown in FIG. 21.
Figure 23:
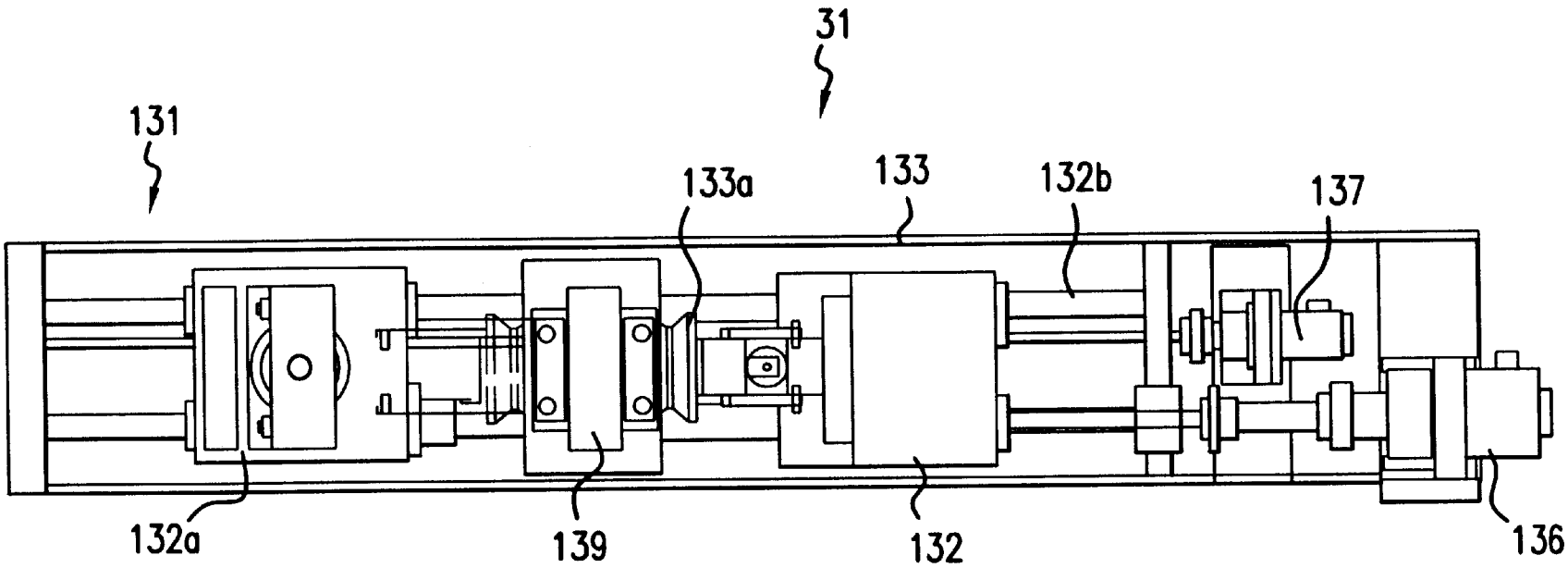
FIG. 23 is a top plan view of the stand shown in FIG. 21.

FIGS. 21, 22 and 23 are end elevational, side elevational and top plan views, respectively, of a brimmed roll stand 31 of the present invention. The brimmed roll 133*a* are carried by brimmed roll holders 133, each of which includes an adjusting mechanism. The brimmed roll holders 133 are mounted to main vertical frames 132. The lateral positions of which are controlled in a manner similar to the lateral position adjustment mechanism of previously described three-point roll stands 21 shown in FIG. 10, i.e., the lateral position is adjusted by operation of the width adjust drive motor 137, and the vertical position of the brimmed roll holders 133 is adjusted by operation of the height adjust drive motor 136.

Figure 24:
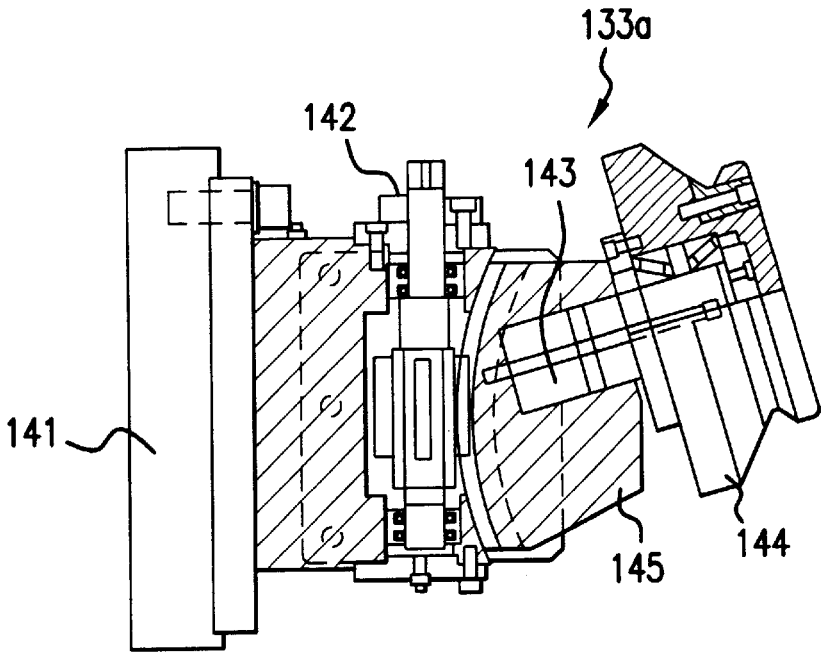
FIG. 24 is a elevational view in partial section of a brimmed roll and its mounting.
Figure 25:
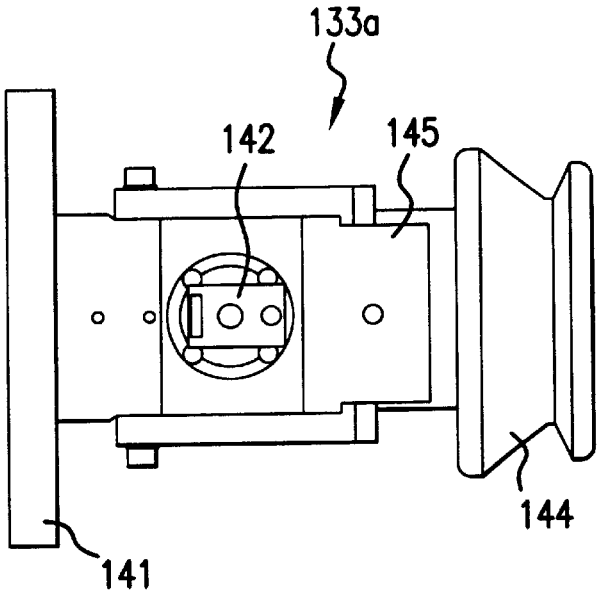
FIG. 25 is a top plan view of the roll and mounting shown in FIG. 24.
Figure 26:
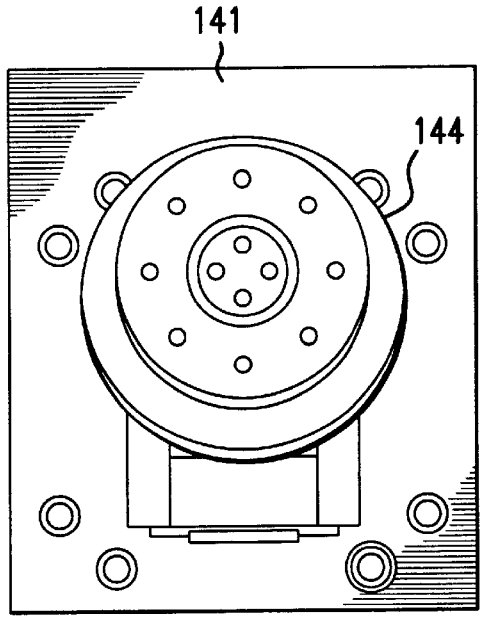
FIG. 26 is a side elevational view of the roll and mounting shown in FIG. 24.
Figure 27:
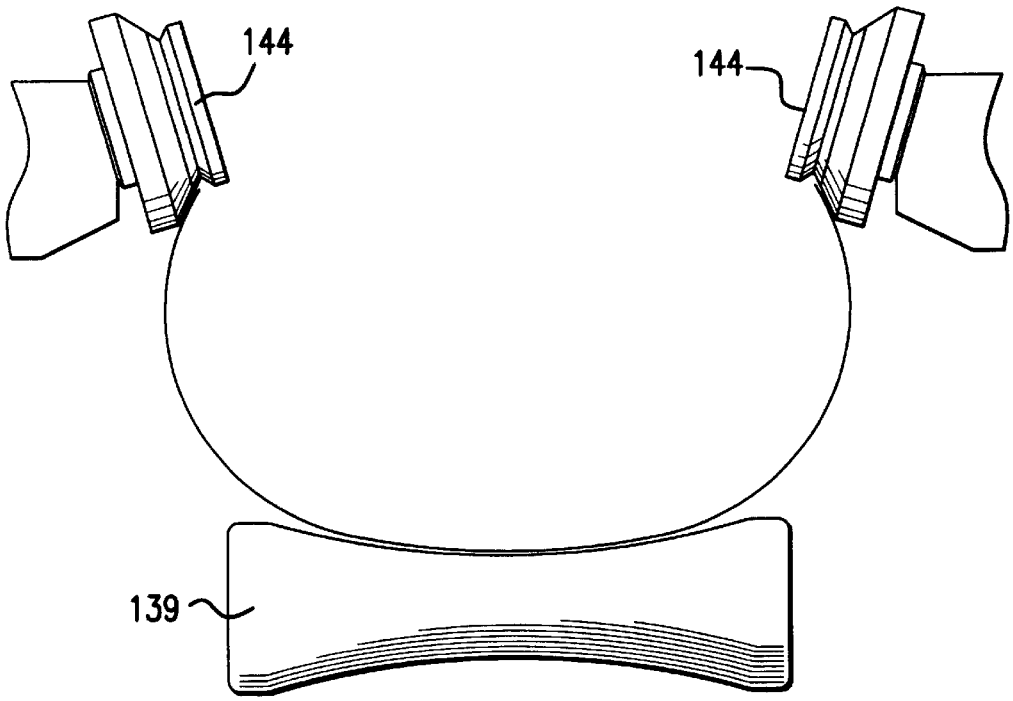
FIG. 27 is an elevational view showing two brimmed rolls and a bottom roll at a forming stand of the present invention.

The brimmed roll stand 31 includes a pair of brimmed rolls 133*a,* each of which engages an edge of a sheet. The shape of a brimmed roll, as shown in FIGS. 24 and 25, includes a cicumferential slot with frustoconica sections forming an angle of somewhat less than about 90 degrees. A third or bottom roll 139 in a brimmed roll stand 31 engages the underside of the sheet to support and provide upward bending force to the sheet which is resisted by the two brimmed rolls 133*a.* The vertical position of the bottom roll 139 is adjusted by operation of the bottom roll height adjust drive motor 136. The motor 135 drives the drive shaft 135*b* which is connected to a worm and worm wheel gearbox 135*a.*

Figure 28:
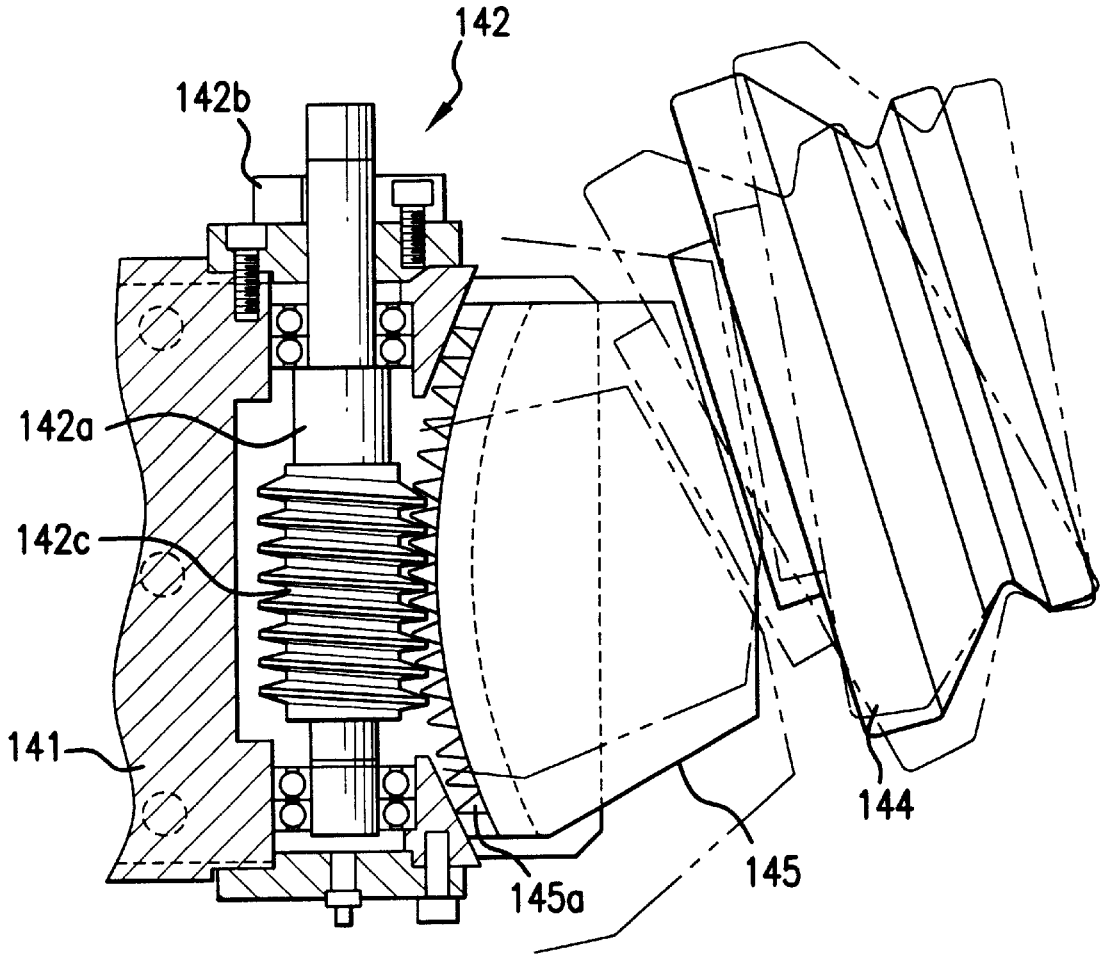
FIG. 28 is a top plan view in partial section of a brimmed roll and its mounting mechanism made in accordance with the present invention.

Adjustment of the brimmed roll body 144, as shown in FIGS. 24, 25, 26 and 28, is in the X-Y plane. Vertical adjustment in the X-Y plane of the position of the brimmed roll body 144 is achieved by use of adjustment mechanism 142. Rotation of the shaft 142*a* results in rotattion of the worm 142*c* carried thereby. The worm 142*c* engages the teeth 145*a* in the top roll holder 145, and rotational movement of the worm 142*c* results in rotation upward and downward of the brimmed roll holder 145 and brimmed roll body 144. Dotted lines in FIG. 28 show various positions of the brimmed roll assembly by 133*a* which achievable by rotation of the worm 142*c*. It should be noted that the worm and associated teeth are shown schematically without reference numerals in FIGS. 21 and 24.

Figure 29:
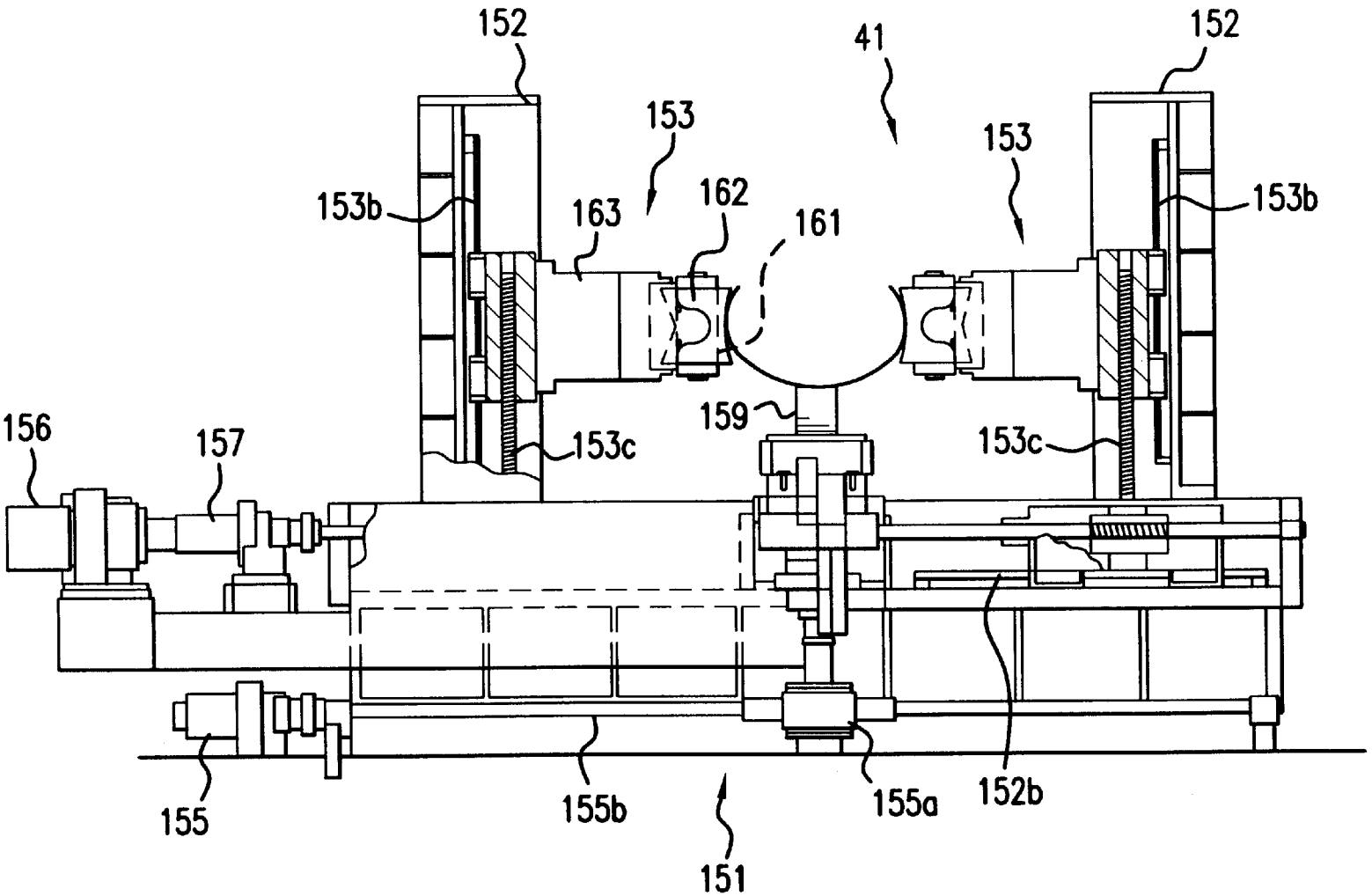
FIG. 29 is an end elevational view of a cage roll stand for use in a machine of the present invention.
Figure 30:
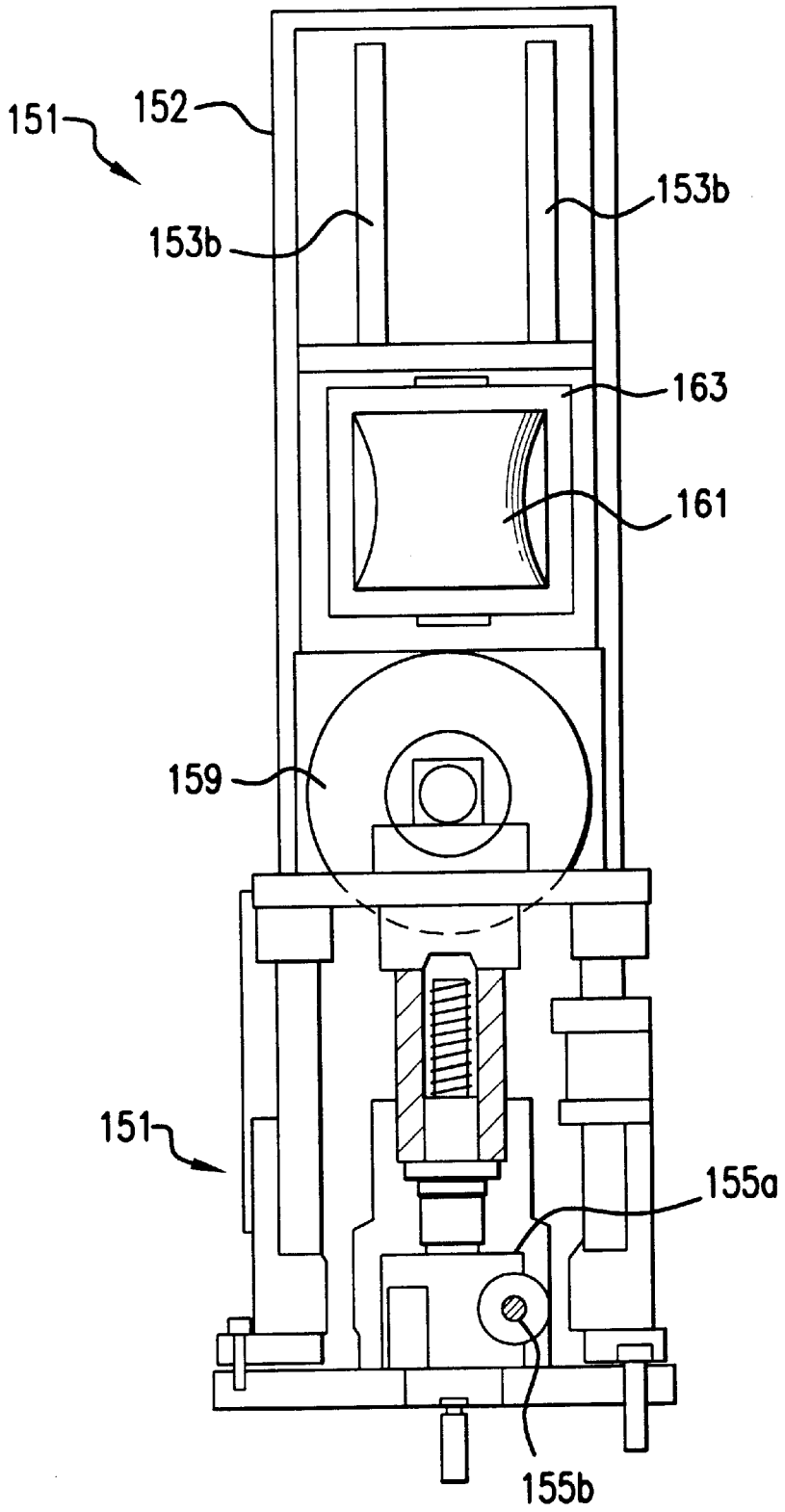
FIG. 30 is a side elevational view of the cage roll stand shown in FIG. 29.

FIG. 29 shows a cage roll stand 41 of the kind used in combination with other roll stands, as shown in FIGS. 1 and 2, to achieve a tube in accordance with the present invention. Opposing forming roll assemblies 153 include cage rolls 161 acting upon a sheet in combination with a single bottom roll 159. Each cage roll 161 is held by a cage roll holder 163, and each cage roll 161 pivots on a cage roll shaft 162. The cage roll holders are mounted to main vertical frames 152, which include vertical slide rails 153*b*. The cage roll holders 163 are raised and lowered by rotation of the screw rod 153*c* within a threaded bore in the cage roll holders 163. The lateral position of the cage rolls 161 is adjusted by operation of the cage roll width adjusting motor 157 which moves the vertical frames 152 on slide rails 152*b*. The cage roll height adjusting motor 156 is used to raise and lower the cage roll holders 163 (and the cage rolls 161). The drive motor 155 drives the shaft 155*b*, which connects to the gear box 155*a*, to raise and lower the bottom roll 159.

Figure 31:
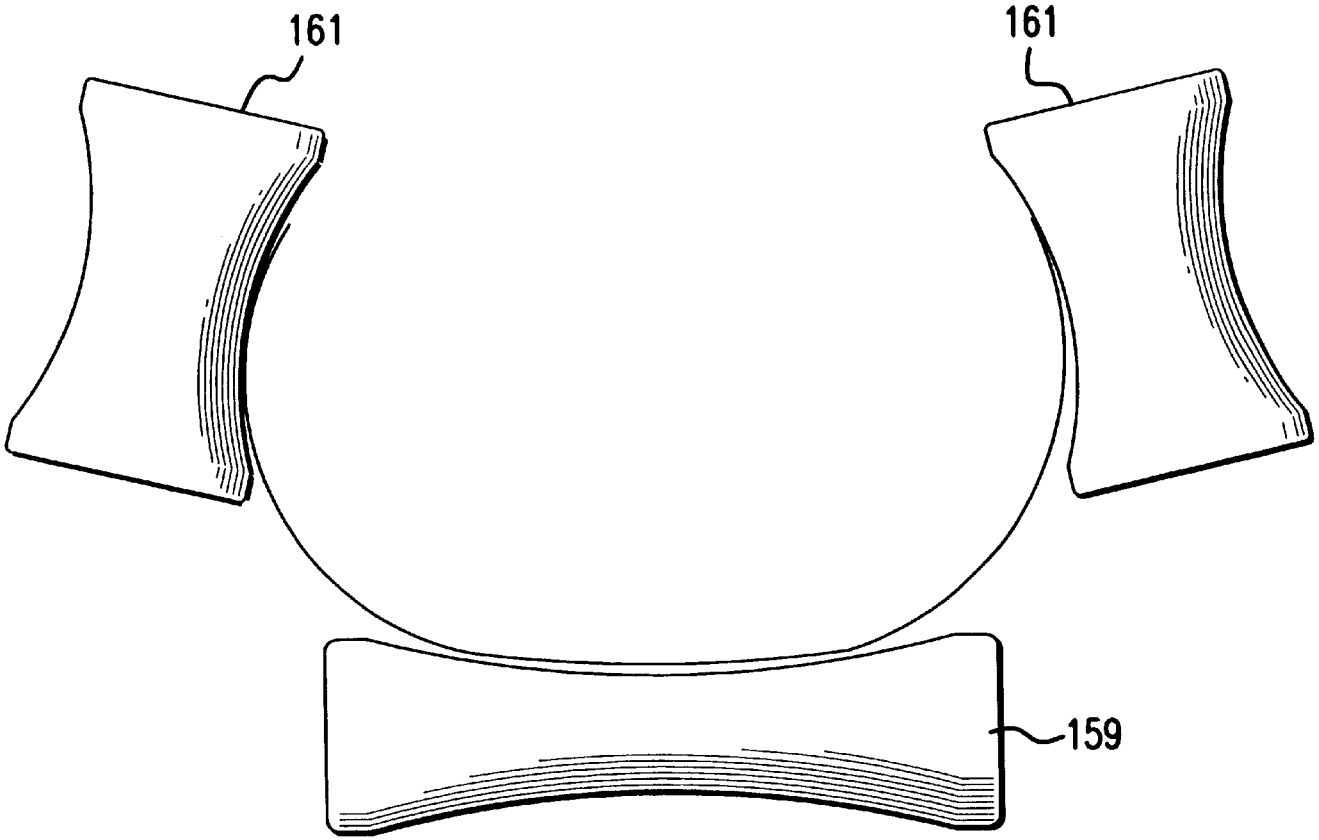
FIG. 31 is a diagram of the rolls in a cage roll stand.
Figure 32:
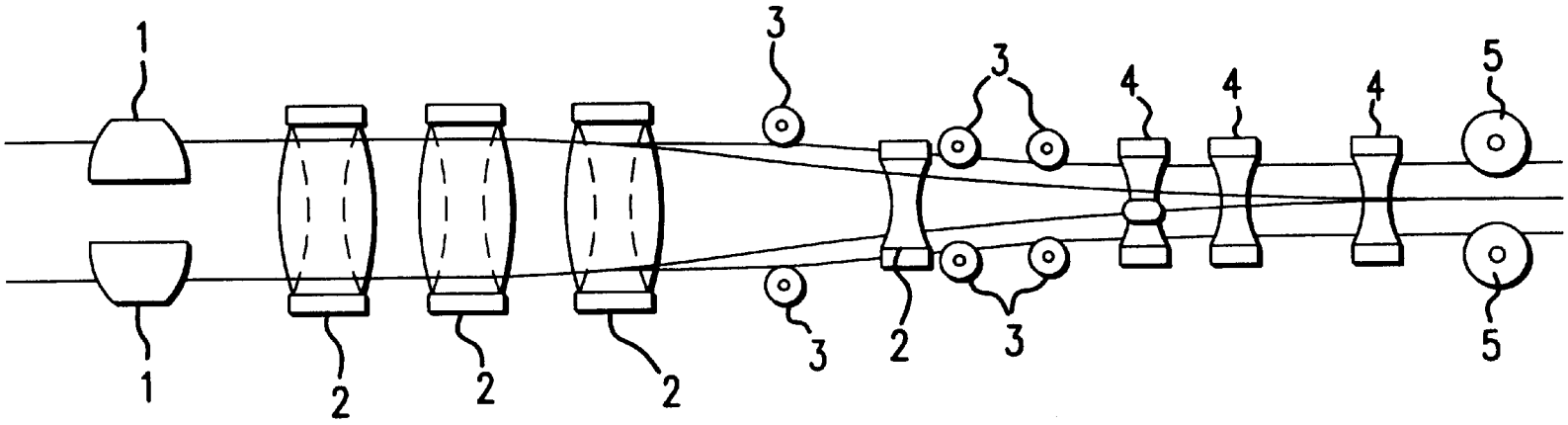
FIGS. 32 and 33 are examples in plan view of conventional tube forming machines.
Figure 33:
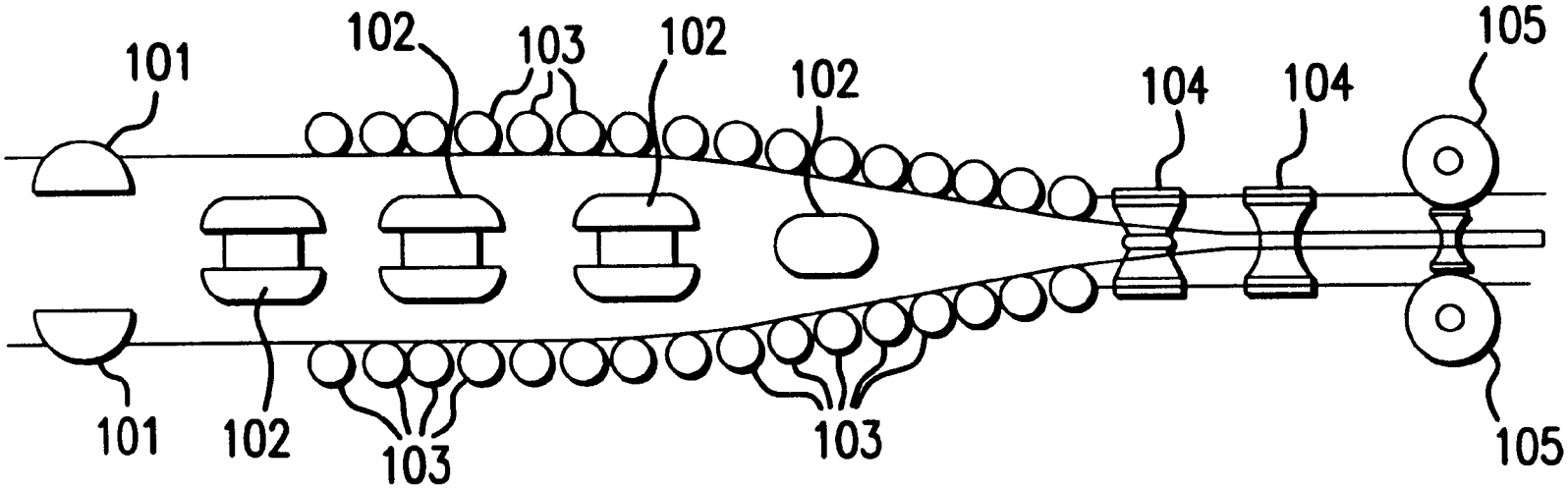

FIG. 31 shows the rolls 161 and 159 which are typical of the cage roll stands 41 used as part of the present invention.

While specific embodiments of the inventions disclosed herein have been shown and described in detail, those embodiments are only examples, and it will be apparent to those skilled in the art that numerous other alternatives, modifications, and variations of the inventions may be made without departing from the spirit and scope of the appended claims.

What is claimed is:

1. A station in a tube forming machine comprising at least one set of forming rolls, said set including a first V-shaped bottom roll and a first top roll opposing said first V-shaped roll, said first V-shaped bottom roll and said first top roll defining a first group of three workpiece engagement locations, said first group of three locations defining a first three-point bending arrangement between said at least one set of forming rolls, said top roll being adjustable toward and away from said bottom roll with said top roll being movable to a plurality of positions defining a line of adjustability, and said bottom roll being mounted rotatable to a bottom roll holder by a bottom roll support shaft, said bottom roll support shaft being generally perpendicular to said line of adjustability, whereby said top roll and said bottom roll are useable together to form tubes with different diameters.

2. A station in a tube forming machine in accordance with claim 1 including a second set of forming rolls, said second set including a second V-shaped bottom roll and a second top roll opposing said second V-shaped bottom roll, said second set of forming rolls defining a second set of three workpiece engagement locations, said second set of three workpiece engagement locations defining a second three-point bending arrangement between said second pair of rolls, said second top roll being adjustable toward and away from said second bottom roll, with said second top roll being movable to a plurality of positions defining a second line of adjustability, and said second bottom roll being mounted rotatable to a bottom roll holder by a second bottom roll support shaft, said second bottom roll support shaft being generally perpendicular to said second line of adjustability.

3. A station in accordance with claim 1 wherein:

said first and second sets of forming rolls are laterally adjacent to one another and opposite sides of a strip of workpiece material are partially formed into a tubular shape by said first and second set of rolls at a single three point bending stand.

4. A station in accordance with claim 1 wherein:

said first V-shaped bottom roll has a central circumferential crease with frustoconical portions adjacent to each side of said crease, said crease defining a plane, said plane being generally parallel to a direction of flow of said workpiece material though said station, said top roll being moveable generally along said plane to form a gap between said top roll and said bottom roll, said gap being usable to determine the curvature imparted to said workpiece material as it passes between said set of rolls.

5. In a tube forming station, a brimmed tube forming roll having a slot for receiving an edge of a sheet, said slot being formed by a first annular portion with a first surface and a second annular portion with a second surface, said first annular portion having a diameter greater than the diameter of said second annular portion, said brimmed tube forming roll being mounted to a roll support and being movable to various positions in an X-Y plane of said station.

6. A tube forming roll in accordance with claim 5 wherein:

said first and second surfaces form said slot with an included angle of less than about 90°.

7. A tube forming roll in accordance with claim 5 wherein said support includes a rotatable worm and a worm wheel segment to which said roll is mounted, whereby said roll may be adjusted to said various positions in said X-Y plane.

8. A tube forming machine with a plurality of forming stations comprising a first station including a first top roll and first bottom roll, said first top roll and said first bottom roll being aligned for gripping and driving a sheet to be formed into a tube, at least a portion of said first bottom roll defining a V-shaped profile, a second station including at least one second bottom roll and at least one second top roll, at least a portion of said second bottom roll having a V-shaped profile, a third station with at least one pair of third top rolls, each of said third top rolls having a circumferential slot into which an edge of said sheet fits, said first top roll being mounted on a support shaft, at least one end of said support shaft being forced by action of separately controllable hydraulic pressing cylinder to urge said first top roll into gripping engagement with said sheet against said first bottom roll.

9. A tube forming machine in accordance with claim 8 wherein:

said second station includes a single second top roll and a single second bottom roll, said single top roll having a width substantially less than the width of said single second bottom roll, whereby engagement of said sheet by said second top roll and said second bottom roll results in three-point bending of said sheet.

10. A tube forming machine in accordance with claim 8 wherein:

said second station includes two sets of second-station rolls, each set comprising a second-station bottom roll having a V-shaped profile and a second-station top roll with a width substantially narrower than said second-station bottom roll, whereby two portions of said sheet are subjected to three-point bending at said second station.

11. A tube forming machine in accordance with claim 8 wherein:

said third top rolls press said sheet against a single third-station bottom roll.

* * * * *